US008157538B2

(12) United States Patent
Wallis et al.

(10) Patent No.: US 8,157,538 B2
(45) Date of Patent: Apr. 17, 2012

(54) CAPACITY MODULATION SYSTEM FOR COMPRESSOR AND METHOD

(75) Inventors: Frank S. Wallis, Sidney, OH (US); Mitch M. Knapke, Maria Stein, OH (US); Ernest R. Bergman, Rossburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 749 days.

(21) Appl. No.: 12/177,528

(22) Filed: Jul. 22, 2008

(65) Prior Publication Data

US 2009/0028723 A1 Jan. 29, 2009

Related U.S. Application Data

(60) Provisional application No. 60/951,274, filed on Jul. 23, 2007.

(51) Int. Cl.
*F04B 49/00* (2006.01)
*F04B 39/10* (2006.01)
*F16K 31/44* (2006.01)

(52) U.S. Cl. ..... 417/298; 417/545; 417/558; 251/63.5; 251/82

(58) Field of Classification Search ..... 417/269, 417/275, 279, 297.5, 298, 309, 311, 324, 417/394, 417, 459, 511, 513, 545, 549, 553, 417/558, 559, 568, 213; 62/229, 324.1; 251/63.5, 82

See application file for complete search history.

(56) References Cited

U.S. PATENT DOCUMENTS

| | | | | |
|---|---|---|---|---|
| 878,562 | A | 2/1908 | Reeve | |
| 1,394,802 | A | 10/1921 | Wineman | |
| 1,408,943 | A | 3/1922 | Holdsworth | |
| 1,584,032 | A | 5/1926 | Hoffman | |
| 1,716,533 | A | 6/1929 | Redfield | |
| 1,796,796 | A * | 3/1931 | Le Valley | 137/543.15 |

(Continued)

FOREIGN PATENT DOCUMENTS

CA 1135368 A1 11/1982

(Continued)

OTHER PUBLICATIONS

Capacity Modulation for Air Conditioning and Refrigeration Systems; Air Conditioning, Heating & Refrigeration News; Earl B. Muir, Manager ofResearch, and Russell W. Griffith, Research Engineer, Copeland Corp.; Apr.-May 1979; 12 Pages.

(Continued)

*Primary Examiner* — Charles Freay
(74) *Attorney, Agent, or Firm* — Harness, Dickey & Pierce, P.L.C.

(57) ABSTRACT

An apparatus is provided and may include a compression mechanism, a valve plate associated with the compression mechanism and having at least one port in fluid communication with the compression mechanism, and a manifold disposed adjacent to the valve plate. A cylinder may be formed in the manifold and a piston may be disposed within the manifold and may be movable relative to the manifold between a first position separated from the valve plate and a second position engaging the valve plate. A valve element may be disposed within the piston and may be movable relative to the piston and the manifold. The valve element may be movable between an open position spaced apart from the valve plate and permitting flow through the port and into the compression mechanism and a closed position engaging the valve plate and restricting flow through the port and into the compression mechanism.

36 Claims, 11 Drawing Sheets

U.S. PATENT DOCUMENTS

| | | | | | |
|---|---|---|---|---|---|
| 1,798,435 | A | | 3/1931 | Saharoff | |
| 1,878,326 | A | | 9/1932 | Ricardo | |
| 1,984,171 | A | | 12/1934 | Baker | |
| 2,134,834 | A | | 11/1938 | Nordberg | |
| 2,134,835 | A | | 11/1938 | Nordberg | |
| 2,171,286 | A | | 8/1939 | Baker | |
| 2,185,473 | A | | 1/1940 | Neeson | |
| 2,206,115 | A | | 7/1940 | Obreiter, Jr. | |
| 2,302,847 | A | | 11/1942 | Ferguson | |
| 2,304,999 | A | | 12/1942 | Gonzalez | |
| 2,346,987 | A | | 4/1944 | Newton | |
| 2,369,841 | A | | 2/1945 | Neeson | |
| 2,412,503 | A | | 12/1946 | Gerteis | |
| 2,421,872 | A | | 6/1947 | Evelyn | |
| 2,423,677 | A | | 7/1947 | Balogh | |
| 2,470,380 | A | | 5/1949 | Turnwald | |
| 2,546,613 | A | | 3/1951 | Paget | |
| 2,602,582 | A | | 7/1952 | Garbaccio | |
| 2,626,099 | A | | 1/1953 | Ashley | |
| 2,626,100 | A | | 1/1953 | Mcintyre | |
| 2,738,659 | A | | 3/1956 | Heed | |
| 2,801,827 | A | | 8/1957 | Dolza | |
| 2,982,467 | A | | 5/1961 | Corson et al. | |
| 3,303,988 | A | | 2/1967 | Weatherhead | |
| 3,653,783 | A | | 4/1972 | Sauder | |
| 3,732,036 | A | | 5/1973 | Busbey et al. | |
| 3,759,057 | A | | 9/1973 | English et al. | |
| 3,790,310 | A | | 2/1974 | Whelan | |
| RE29,283 | E | | 6/1977 | Shaw | |
| RE29,621 | E | | 5/1978 | Conley et al. | |
| 4,105,371 | A | | 8/1978 | Savage et al. | |
| 4,112,703 | A | | 9/1978 | Kountz | |
| 4,132,086 | A | | 1/1979 | Kountz | |
| 4,152,902 | A | | 5/1979 | Lush | |
| 4,184,341 | A | | 1/1980 | Friedman | |
| 4,220,197 | A | | 9/1980 | Schaefer et al. | |
| 4,227,862 | A | | 10/1980 | Andrew et al. | |
| 4,231,713 | A | | 11/1980 | Widdowson et al. | |
| 4,249,866 | A | | 2/1981 | Shaw et al. | |
| 4,267,702 | A | | 5/1981 | Houk | |
| 4,336,001 | A | | 6/1982 | Andrew et al. | |
| 4,361,417 | A | | 11/1982 | Suzuki | |
| 4,362,475 | A | | 12/1982 | Seitz | |
| 4,370,103 | A | * | 1/1983 | Tripp | 417/298 |
| 4,384,462 | A | | 5/1983 | Overman et al. | |
| 4,396,345 | A | | 8/1983 | Hutchinson | |
| 4,406,589 | A | | 9/1983 | Tsuchida et al. | |
| 4,407,639 | A | | 10/1983 | Maruyama | |
| 4,419,866 | A | | 12/1983 | Howland | |
| 4,432,705 | A | * | 2/1984 | Fraser et al. | 417/295 |
| 4,437,317 | A | | 3/1984 | Ibrahim | |
| 4,442,680 | A | | 4/1984 | Barbier et al. | |
| 4,447,196 | A | | 5/1984 | Nagasaku et al. | |
| 4,452,571 | A | | 6/1984 | Koda et al. | |
| 4,459,817 | A | | 7/1984 | Inagaki et al. | |
| 4,463,573 | A | | 8/1984 | Zeno et al. | |
| 4,463,576 | A | | 8/1984 | Burnett et al. | |
| 4,481,784 | A | | 11/1984 | Elmslie | |
| 4,494,383 | A | | 1/1985 | Nagatomo et al. | |
| 4,506,517 | A | | 3/1985 | Pandzik | |
| 4,506,518 | A | | 3/1985 | Yoshikawa et al. | |
| 4,507,936 | A | | 4/1985 | Yoshino | |
| 4,522,568 | A | | 6/1985 | Gelse et al. | 417/307 |
| 4,575,318 | A | | 3/1986 | Blain | |
| 4,580,947 | A | | 4/1986 | Shibata et al. | |
| 4,580,949 | A | | 4/1986 | Maruyama et al. | |
| 4,588,359 | A | | 5/1986 | Hikade | 417/298 |
| 4,610,610 | A | | 9/1986 | Blain | |
| 4,612,776 | A | | 9/1986 | Alsenz | |
| 4,632,145 | A | * | 12/1986 | Machu | 137/516.21 |
| 4,632,358 | A | | 12/1986 | Orth et al. | |
| 4,634,046 | A | | 1/1987 | Tanaka | |
| 4,638,973 | A | | 1/1987 | Torrence | |
| 4,651,535 | A | | 3/1987 | Alsenz | |
| 4,655,689 | A | | 4/1987 | Westveer et al. | |
| 4,663,725 | A | | 5/1987 | Truckenbrod et al. | |
| 4,669,272 | A | | 6/1987 | Kawai et al. | |
| 4,685,309 | A | | 8/1987 | Behr | |
| 4,697,421 | A | | 10/1987 | Otobe et al. | |
| 4,697,431 | A | | 10/1987 | Alsenz | |
| 4,715,792 | A | | 12/1987 | Nishizawa et al. | |
| 4,723,895 | A | | 2/1988 | Hayase | |
| 4,726,740 | A | | 2/1988 | Suzuki et al. | |
| 4,727,725 | A | | 3/1988 | Nagata et al. | |
| 4,743,168 | A | | 5/1988 | Yannascoli | |
| 4,744,733 | A | | 5/1988 | Terauchi et al. | |
| 4,747,756 | A | | 5/1988 | Sato et al. | |
| 4,756,166 | A | | 7/1988 | Tomasov | |
| 4,764,096 | A | | 8/1988 | Sawai et al. | |
| 4,789,025 | A | | 12/1988 | Brandemuehl et al. | |
| 4,794,759 | A | | 1/1989 | Lyon | |
| 4,831,832 | A | | 5/1989 | Alsenz | |
| 4,838,766 | A | | 6/1989 | Kimura et al. | |
| 4,843,834 | A | | 7/1989 | Inoue et al. | |
| 4,848,101 | A | | 7/1989 | Suzuki | |
| 4,856,291 | A | | 8/1989 | Takahashi | |
| 4,860,549 | A | | 8/1989 | Murayama | |
| 4,869,289 | A | * | 9/1989 | Hrabal | 137/512.1 |
| 4,869,291 | A | | 9/1989 | Hrabal | |
| 4,875,341 | A | | 10/1989 | Brandemuehl et al. | |
| 4,878,818 | A | * | 11/1989 | Shaw | 417/308 |
| 4,880,356 | A | | 11/1989 | Suzuki et al. | |
| 4,892,466 | A | | 1/1990 | Taguchi et al. | |
| 4,893,480 | A | | 1/1990 | Matsui et al. | |
| 4,896,860 | A | | 1/1990 | Malone et al. | |
| 4,910,968 | A | | 3/1990 | Yamashita et al. | |
| 4,926,652 | A | | 5/1990 | Kitamoto | |
| 4,932,220 | A | | 6/1990 | Inoue | |
| 4,932,632 | A | | 6/1990 | Nicol | |
| 4,934,157 | A | | 6/1990 | Suzuki et al. | |
| 4,938,684 | A | | 7/1990 | Karl et al. | |
| 4,946,350 | A | | 8/1990 | Suzuki et al. | |
| 4,951,475 | A | | 8/1990 | Alsenz | |
| 4,962,648 | A | | 10/1990 | Takizawa et al. | |
| 4,968,221 | A | | 11/1990 | Noll | |
| 4,974,427 | A | | 12/1990 | Diab | |
| 5,006,045 | A | | 4/1991 | Shimoda et al. | |
| 5,007,247 | A | | 4/1991 | Danig | |
| 5,009,074 | A | | 4/1991 | Goubeaux et al. | |
| 5,015,155 | A | | 5/1991 | Brown | |
| 5,018,366 | A | | 5/1991 | Tanaka et al. | |
| 5,022,234 | A | | 6/1991 | Goubeaux et al. | |
| 5,025,636 | A | | 6/1991 | Terauchi | |
| 5,027,612 | A | | 7/1991 | Terauchi | |
| 5,035,119 | A | | 7/1991 | Alsenz | |
| 5,052,899 | A | | 10/1991 | Peterson | |
| 5,056,990 | A | | 10/1991 | Nakajima | |
| 5,059,098 | A | | 10/1991 | Suzuki et al. | |
| 5,065,750 | A | | 11/1991 | Maxwell | |
| 5,067,326 | A | | 11/1991 | Alsenz | |
| 5,079,929 | A | | 1/1992 | Alsenz | |
| 5,088,297 | A | | 2/1992 | Maruyama et al. | |
| 5,094,085 | A | | 3/1992 | Irino | |
| 5,115,644 | A | | 5/1992 | Alsenz | |
| 5,129,791 | A | | 7/1992 | Nakajima | |
| 5,156,013 | A | | 10/1992 | Arima et al. | |
| 5,163,301 | A | | 11/1992 | Cahill-O'Brien et al. | |
| 5,190,446 | A | | 3/1993 | Salter et al. | |
| 5,191,643 | A | | 3/1993 | Alsenz | |
| 5,191,768 | A | | 3/1993 | Fujii | |
| 5,199,855 | A | | 4/1993 | Nakajima et al. | |
| 5,203,179 | A | | 4/1993 | Powell | |
| 5,211,026 | A | | 5/1993 | Linnert | |
| 5,226,472 | A | | 7/1993 | Benevelli et al. | |
| 5,228,301 | A | | 7/1993 | Sjoholm et al. | |
| 5,241,833 | A | | 9/1993 | Ohkoshi | |
| 5,243,827 | A | | 9/1993 | Hagita et al. | |
| 5,243,829 | A | | 9/1993 | Bessler | |
| 5,244,357 | A | | 9/1993 | Bauer | |
| 5,253,482 | A | | 10/1993 | Murway | |
| 5,259,210 | A | | 11/1993 | Ohya et al. | |
| 5,263,333 | A | | 11/1993 | Kubo et al. | |
| 5,265,434 | A | | 11/1993 | Alsenz | |
| 5,282,329 | A | | 2/1994 | Teranishi | |
| 5,282,729 | A | | 2/1994 | Swain | |
| 5,319,943 | A | | 6/1994 | Bahel et al. | |
| 5,342,186 | A | | 8/1994 | Swain | |

| | | | | |
|---|---|---|---|---|
| 5,363,649 | A | 11/1994 | McBurnett et al. | |
| 5,381,669 | A | 1/1995 | Bahel et al. | |
| 5,388,968 | A | 2/1995 | Wood et al. | |
| 5,392,612 | A | 2/1995 | Alsenz | |
| 5,396,780 | A | 3/1995 | Bendtsen | |
| 5,400,609 | A | 3/1995 | Sjoholm et al. | |
| 5,415,005 | A | 5/1995 | Sterber et al. | |
| 5,415,008 | A | 5/1995 | Bessler | |
| 5,425,246 | A | 6/1995 | Bessler | |
| 5,426,952 | A | 6/1995 | Bessler | |
| 5,431,026 | A | 7/1995 | Jaster | |
| 5,435,145 | A | 7/1995 | Jaster | |
| 5,438,844 | A | 8/1995 | Hoglund et al. | |
| 5,440,891 | A | 8/1995 | Hindmon, Jr. et al. | |
| 5,440,894 | A | 8/1995 | Schaeffer et al. | |
| 5,447,420 | A | 9/1995 | Caillat et al. | |
| 5,463,876 | A | 11/1995 | Bessler et al. | |
| 5,492,450 | A | 2/1996 | Bearint et al. | |
| 5,493,867 | A | 2/1996 | Szynal et al. | |
| 5,502,970 | A | 4/1996 | Rajendran | |
| 5,515,267 | A | 5/1996 | Alsenz | |
| 5,533,873 | A | 7/1996 | Kindl | |
| 5,540,558 | A | 7/1996 | Harden et al. | |
| 5,546,756 | A | 8/1996 | Ali | |
| 5,562,426 | A | 10/1996 | Watanabe et al. | |
| 5,572,879 | A | 11/1996 | Harrington et al. | |
| 5,591,014 | A | 1/1997 | Wallis et al. | |
| 5,600,961 | A | 2/1997 | Whipple, III | |
| 5,611,674 | A | 3/1997 | Bass et al. | |
| 5,613,841 | A | 3/1997 | Bass et al. | |
| 5,634,350 | A | 6/1997 | De Medio | |
| 5,642,989 | A | 7/1997 | Keddie | |
| 5,688,111 | A | 11/1997 | Takai | |
| 5,713,724 | A | 2/1998 | Centers et al. | |
| 5,735,134 | A | 4/1998 | Liu et al. | |
| 5,741,120 | A | 4/1998 | Bass et al. | |
| 5,762,483 | A | 6/1998 | Lifson et al. | |
| 5,765,391 | A | 6/1998 | Lee et al. | |
| 5,785,081 | A | 7/1998 | Krawczyk et al. | |
| 5,807,081 | A | 9/1998 | Schutte et al. | |
| 5,816,055 | A | 10/1998 | Ohman | |
| 5,855,475 | A | 1/1999 | Fujio et al. | |
| 5,865,604 | A | 2/1999 | Kawaguchi et al. | |
| 5,947,701 | A | 9/1999 | Hugenroth | |
| 5,967,761 | A | 10/1999 | Mehaffey | |
| 6,026,587 | A | 2/2000 | Cunkelman et al. | |
| 6,042,344 | A | 3/2000 | Lifson | |
| 6,047,556 | A | 4/2000 | Lifson | |
| 6,077,051 | A | 6/2000 | Centers et al. | |
| 6,086,335 | A | 7/2000 | Bass et al. | |
| 6,148,632 | A | 11/2000 | Kishita et al. | |
| 6,206,652 | B1 | 3/2001 | Caillat | |
| 6,213,731 | B1 | 4/2001 | Doepker et al. | |
| 6,238,188 | B1 | 5/2001 | Lifson | |
| 6,257,848 | B1 | 7/2001 | Terauchi | |
| 6,393,852 | B2 | 5/2002 | Pham et al. | |
| 6,408,635 | B1 | 6/2002 | Pham et al. | |
| 6,431,210 | B1 | 8/2002 | Lowe et al. | |
| 6,438,974 | B1 | 8/2002 | Pham et al. | |
| 6,449,972 | B2 | 9/2002 | Pham et al. | |
| 6,467,280 | B2 | 10/2002 | Pham et al. | |
| 6,481,976 | B2 | 11/2002 | Kimura et al. | |
| 6,517,332 | B1 | 2/2003 | Lifson et al. | |
| 6,520,751 | B2 | 2/2003 | Fujita et al. | |
| 6,561,482 | B2 | 5/2003 | Okii | |
| 6,575,710 | B2 * | 6/2003 | Wallis | 417/298 |
| 6,619,934 | B2 | 9/2003 | Loprete et al. | |
| 6,626,645 | B2 | 9/2003 | Okii et al. | |
| 6,662,578 | B2 | 12/2003 | Pham et al. | |
| 6,662,583 | B2 | 12/2003 | Pham et al. | |
| 6,663,358 | B2 | 12/2003 | Loprete et al. | |
| 6,676,388 | B2 | 1/2004 | Lee et al. | |
| 6,679,072 | B2 | 1/2004 | Pham et al. | |
| 6,715,999 | B2 | 4/2004 | Ancel et al. | |
| 6,772,990 | B2 | 8/2004 | Sasaki et al. | |
| 6,824,120 | B2 | 11/2004 | Furuta et al. | |
| 6,868,685 | B2 | 3/2005 | Kim | |
| 6,971,861 | B2 | 12/2005 | Black et al. | |
| 7,037,087 | B2 | 5/2006 | Uemura et al. | |
| 7,331,767 | B2 * | 2/2008 | Spiegl et al. | 417/53 |
| RE40,400 | E | 6/2008 | Bass et al. | |
| 7,389,649 | B2 | 6/2008 | Pham et al. | |
| 7,419,365 | B2 | 9/2008 | Pham et al. | |
| RE40,554 | E | 10/2008 | Bass et al. | |
| RE40,830 | E | 7/2009 | Caillat | |
| 7,654,098 | B2 | 2/2010 | Pham et al. | |
| 7,819,131 | B2 * | 10/2010 | Walpole | 137/533.23 |
| 2001/0003573 | A1 | 6/2001 | Kimura et al. | |
| 2001/0011463 | A1 | 8/2001 | Pollrich et al. | |
| 2001/0031207 | A1 | 10/2001 | Maeda et al. | |
| 2002/0182087 | A1 | 12/2002 | Okii et al. | |
| 2005/0025648 | A1 | 2/2005 | Shimizu et al. | |
| 2005/0031459 | A1 | 2/2005 | Hibino et al. | |
| 2006/0218953 | A1 | 10/2006 | Hirota | |
| 2006/0218959 | A1 * | 10/2006 | Sandkoetter | 62/324.1 |
| 2007/0022771 | A1 | 2/2007 | Pham et al. | |
| 2008/0131297 | A1 | 6/2008 | Hibino et al. | |
| 2008/0175727 | A1 | 7/2008 | Umemura et al. | |

FOREIGN PATENT DOCUMENTS

| | | | |
|---|---|---|---|
| CN | 1137614 | A | 12/1996 |
| CN | 1159555 | A | 9/1997 |
| DE | 764179 | C | 4/1953 |
| DE | 3422398 | A1 | 12/1985 |
| DE | 42 12 162 | | 10/1993 |
| EP | 0060315 | A1 | 9/1982 |
| EP | 0085246 | A1 | 8/1983 |
| EP | 0087818 | A2 | 9/1983 |
| EP | 0222109 | A1 | 5/1987 |
| EP | 0 281 317 | A1 | 9/1988 |
| EP | 0309242 | A2 | 3/1989 |
| EP | 0403239 | A2 | 12/1990 |
| EP | 0482592 | A1 | 4/1992 |
| EP | 0747597 | A2 | 12/1996 |
| EP | 0747598 | A2 | 12/1996 |
| EP | 0777052 | A2 | 6/1997 |
| EP | 0814262 | A2 | 12/1997 |
| EP | 0871818 | A1 | 10/1998 |
| EP | 1 489 368 | A2 | 12/2004 |
| EP | 1 710 435 | A1 | 10/2006 |
| GB | 551304 | A | 2/1943 |
| GB | 654451 | A | 6/1951 |
| GB | 733511 | A | 7/1955 |
| GB | 762110 | A | 11/1956 |
| GB | 889286 | A | 2/1962 |
| GB | 1054080 | A | 1/1967 |
| GB | 1248888 | A | 10/1971 |
| GB | 2043863 | A | 10/1980 |
| GB | 2116635 | A | 9/1983 |
| GB | 2269246 | A | 2/1994 |
| GB | 2269684 | A | 2/1994 |
| GB | 2247543 | A | 3/1994 |
| JP | 54064711 | A | 5/1979 |
| JP | 57-162988 | | 4/1981 |
| JP | 57-204381 | | 12/1982 |
| JP | 57200685 | A | 12/1982 |
| JP | 58195089 | A | 11/1983 |
| JP | S58-214644 | | 12/1983 |
| JP | 59145392 | A | 8/1984 |
| JP | 61-107989 | | 7/1986 |
| JP | 62-003190 | | 1/1987 |
| JP | 62-003191 | | 1/1987 |
| JP | 62-29779 | | 2/1987 |
| JP | 62-125262 | | 6/1987 |
| JP | 62-125263 | | 6/1987 |
| JP | 63205478 | A | 8/1988 |
| JP | 63-138490 | | 9/1988 |
| JP | S61-138490 | | 9/1988 |
| JP | 63266178 | A | 11/1988 |
| JP | 01200079 | | 8/1989 |
| JP | 2115577 | A | 4/1990 |
| JP | 02-173369 | | 7/1990 |
| JP | 02191882 | | 7/1990 |
| JP | 03138473 | | 6/1991 |
| JP | 3199677 | A | 8/1991 |
| JP | 04284194 | | 10/1992 |
| JP | 05164043 | | 6/1993 |
| JP | 05187357 | | 7/1993 |

| | | | |
|---|---|---|---|
| JP | 06093971 | A | 4/1994 |
| JP | 6 207602 | | 7/1994 |
| JP | 07305906 | A | 11/1995 |
| JP | 08284842 | A | 10/1996 |
| JP | 09280171 | | 10/1997 |
| JP | 10037863 | A | 2/1998 |
| JP | 2005256793 | A | 9/2005 |
| JP | 2008208757 | A | 9/2008 |
| WO | 8910768 | A1 | 11/1989 |
| WO | 9007683 | A1 | 7/1990 |
| WO | 9306423 | A1 | 4/1993 |
| WO | 2005/022053 | A1 | 3/2005 |

OTHER PUBLICATIONS

Judgment—Bd.R. 127(b), *Jean-Luc Caillat* v. *Alexander Lifson*, Patent Interference No. 105,288; Jul. 5, 2005; 3 Pages.

Rejection Decision regarding CN200510064854.7 dated Feb. 6, 2009.

First Office Action dated Jul. 4, 2008 regarding Application No. 200610128576.1, received from the Patent Office of the People's Republic of China translated by CCPIT Patent and Trademark Law Office.

Second Office Action dated Apr. 17, 2009 regarding Application No. 200610128576.1 received from the Patent Office of the People's Republic of China translated by CCPIT and Trademark Law Office.

Notification of Second Office Action received from the Patent Office of the People's Republic of China dated May 5, 2009 regarding Application No. 200410085953.9, translated by CCPIT Patent and Trademark Office.

Extended European Search Report regarding Application No. EP 05016504 dated May 25, 2009.

Communication pursuant to Article 94(3) EPC received from the European Patent Office regarding Application No. 04022920.5-2301 dated Jun. 15, 2009.

Third Office Action dated Aug. 21, 2009 regarding Application No. 200610128576.1 received from the Patent Office of the People's Republic of China translated by CCPIT and Trademark Law Office.

European Search Report for Application No. EP 04 02 8437, dated Feb. 7, 2007.

International Search Report regarding International Application No. PCT/US2010/022230, dated Aug. 31, 2010.

Written Opinion of the International Searching Authority regarding International Application No. PCT/US2010/022230, dated Aug. 31, 2010.

International Search Report regarding International Application No. PCT/US2008/008939 dated Mar. 25, 2009.

Written Opinion of the International Searching Authority regarding International Application No. PCT/US2008/008939 dated Mar. 25, 2009.

International Preliminary Report on Patentability regarding International Application No. PCT/US2008/008939 dated Jan. 26, 2010.

First Official Report, Australian Patent Application No. 2008294060, dated Mar. 23, 2011.

Ashrae Handbook & Product Directory, 1979 Equipment, American Society of Heating, Refrigerating and Air-Conditioning Engineers, Inc., 1979, 6 Pages.

Maintenance Manual, Thermo King Corp., SB-III SR + uP IV +, 1995, 3 Pages.

Bitzer, Technical Information, Manual, 20 pages, KT-100-2, Bitzer International, Sindelfingen, Germany.

Second Official Report, Australian Patent Application No. 2008294060, dated Sep. 13, 2011.

* cited by examiner

CAPACITY MODULATION SYSTEM FOR COMPRESSOR AND METHOD

CROSS-REFERENCE TO RELATED APPLICATIONS

This application claims the benefit of U.S. Provisional Application No. 60/951,274 filed on Jul. 23, 2007. The disclosure of the above application is incorporated herein by reference.

FIELD

The present disclosure relates generally to compressors and more particularly to a capacity modulation system and method for a compressor.

BACKGROUND

Heat pump and refrigeration systems are commonly operated under a wide range of loading conditions due to changing environmental conditions. In order to effectively and efficiently accomplish a desired cooling and/or heating under these changing conditions, conventional heat pump or refrigeration systems may incorporate a compressor having a capacity modulation system that adjusts an output of the compressor based on the environmental conditions.

SUMMARY

An apparatus is provided and may include a compression mechanism, a valve plate associated with the compression mechanism and having at least one port in fluid communication with the compression mechanism, and a manifold disposed adjacent to the valve plate. A cylinder may be formed in the manifold and a piston may be disposed within the manifold and may be movable relative to the manifold between a first position separated from the valve plate and a second position engaging the valve plate. A valve element may be disposed within the piston and may be movable relative to the piston and the manifold. The valve element may be movable between an open position spaced apart from the valve plate and permitting flow through the port and into the compression mechanism and a closed position engaging the valve plate and restricting flow through the port and into the compression mechanism.

An apparatus is provided and may include a compression mechanism, a valve plate associated with the compression mechanism and having at least one port in fluid communication with the compression mechanism, and a manifold disposed adjacent to the valve plate. A cylinder may be formed in the manifold and a piston may be disposed within the cylinder and may be movable relative to the cylinder between a first position spaced apart from the valve plate to allow flow through the port and into the compression mechanism and a second position engaging the valve plate to restrict flow through the port and into the compression mechanism. A seal may be disposed between the piston and the cylinder and may include a seal chamber receiving pressurized fluid therein to bias the piston into the first position. A valve mechanism may be in fluid communication with the cylinder and may selectively supply pressurized fluid to the cylinder to move the piston against a force applied on the piston by the pressurized fluid disposed within the seal chamber to move the piston from the first position to the second position.

An apparatus is provided and may include a compression mechanism, a valve plate associated with the compression mechanism, and a pressure-responsive unloader valve movable between a first position permitting flow through the valve plate and into the compression mechanism and a second position restricting flow through the valve plate and into the compression mechanism. A control valve may move the unloader valve between the first position and the second position and may include at least one pressure-responsive valve member movable between a first state supplying discharge-pressure gas to the unloader valve to urge the unloader valve into one of the first position and the second position and a second state venting the discharge-pressure gas from the unloader valve to move the unloader valve into the other of the first position and the second position.

A method is provided and may include selectively providing a chamber with a control fluid, applying a force on a first end of a piston disposed within the chamber by the control fluid, and providing an interior volume of the piston with the control fluid. The method may further include applying a force on a disk disposed within the piston by the control fluid to urge the disk to a second end of the piston, moving the piston and the disk relative to the chamber under force of the control fluid, contacting a valve plate of a compressor with the disk, and contacting the valve plate of the compressor with a body of the piston following contact of the disk and the valve plate.

A method is provided and may include selectively providing a chamber with a control fluid, applying a force on a first end of a piston disposed within the chamber by the control fluid to move the piston in a first direction relative to the chamber, and directing the control fluid through a bore formed in the piston to open a valve and permit the control fluid to pass through the piston. The method may further include communicating the control fluid to an unloader valve to move the unloader valve into one of a first position permitting suction-pressure gas to a combustion chamber of a compressor and a second position preventing suction-pressure gas to the combustion chamber of the compressor.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
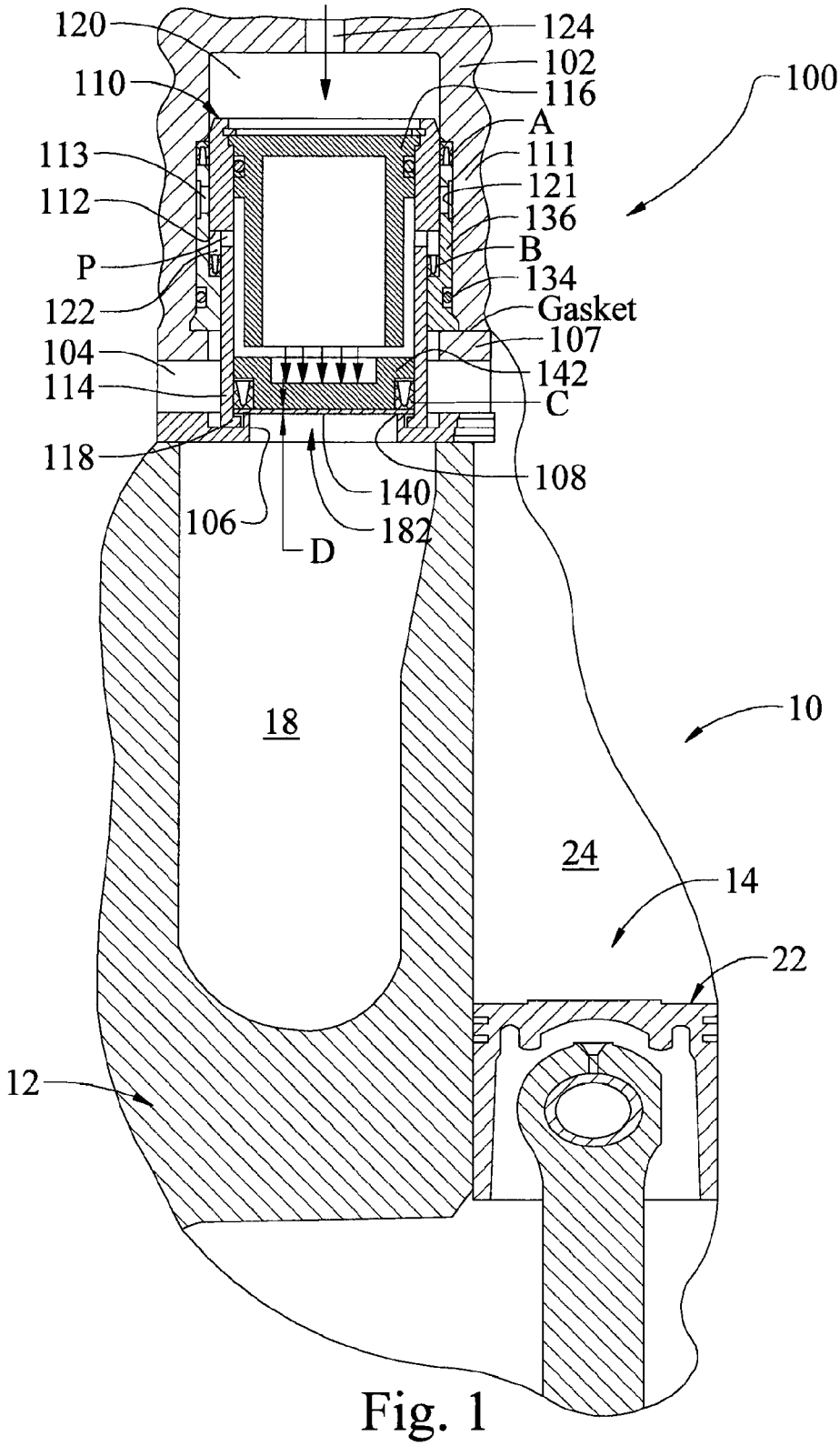
FIG. 1 is a cross-sectional view of a compressor incorporating a valve apparatus according to the present disclosure shown in a closed position.

The following description is merely exemplary in nature and is not intended to limit the present disclosure, application, or uses. It should be understood that throughout the drawings, corresponding reference numerals indicate like or corresponding parts and features. The present teachings are suitable for incorporation in many different types of scroll and rotary compressors, including hermetic machines, open drive machines and non-hermetic machines.

Various embodiments of a valve apparatus are disclosed that allow or prohibit fluid flow, and may be used to modulate fluid flow to a compressor, for example. The valve apparatus includes a chamber having a piston slidably disposed therein, and a control pressure passage in communication with the chamber. A control pressure communicated to the chamber biases the piston for moving the piston relative to a valve opening, to thereby allow or prohibit fluid communication through the valve opening. When pressurized fluid is communicated to the chamber, the piston is biased to move against the valve opening, and may be used for blocking fluid flow to a suction inlet of a compressor, for example. The valve apparatus may be a separate component that is spaced apart from but fluidly coupled to an inlet of a compressor, or may alternatively be a component included within a compressor assembly. The valve apparatus may be operated together with a compressor, for example, as an independent unit that may be controlled by communication of a control pressure via an external flow control device. The valve apparatus may also optionally include a pressure-responsive valve member and a solenoid valve, to selectively provide for communication of a high or low control pressure fluid to the control pressure passage.

Referring to FIG. 1, a pressure-responsive valve apparatus or unloader valve 100 is shown including a chamber 120 having a piston assembly 110 disposed therein, which moves relative to an opening 106 in a valve plate 107 to control fluid flow therethrough. The piston 110 may be moved by communication of a control pressure to the chamber 120 in which the piston 110 is disposed. The control pressure may be one of a low pressure and a high pressure, which may be communicated to the chamber 120 by a valve, for example. To selectively provide a high or low control pressure, the valve apparatus 100 may optionally include a pressure-responsive valve member and a solenoid valve, which will be described later.

Figure 2:
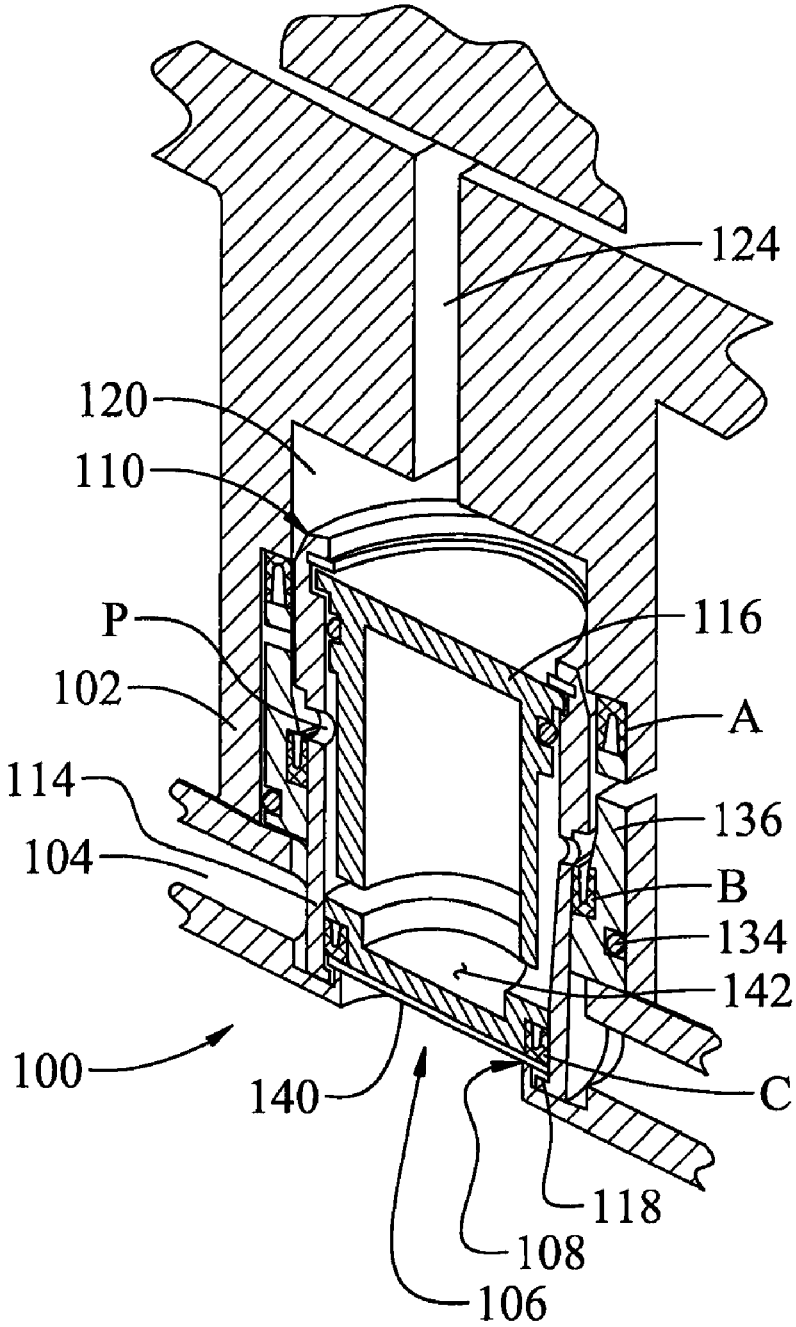
FIG. 2 is a perspective view of the valve apparatus of FIG. 1.

As shown in FIGS. 1 and 2, the piston 110 is capable of prohibiting fluid flow through the valve apparatus 100, and may be used for blocking fluid flow to a passage 104 in communication with the suction inlet of a compressor 10. While the valve apparatus 100 will be described hereinafter as being associated with a compressor 10, the valve apparatus 100 could also be associated with a pump, or used in other applications to control fluid flow.

The compressor 10 may include a manifold 12, a compression mechanism 14, and a discharge assembly 16. The manifold 12 may be disposed in close proximity to the valve plate 107 and may include at least one suction chamber 18. The compression mechanism 14 may similarly be disposed within the manifold 12 and may include at least one piston 22 received generally within a cylinder 24 formed in the manifold 12. The discharge assembly 18 may be disposed at an outlet of the cylinder 24 and may include a discharge-valve 26 that controls a flow of discharge-pressure gas from the cylinder 24.

Figure 10:
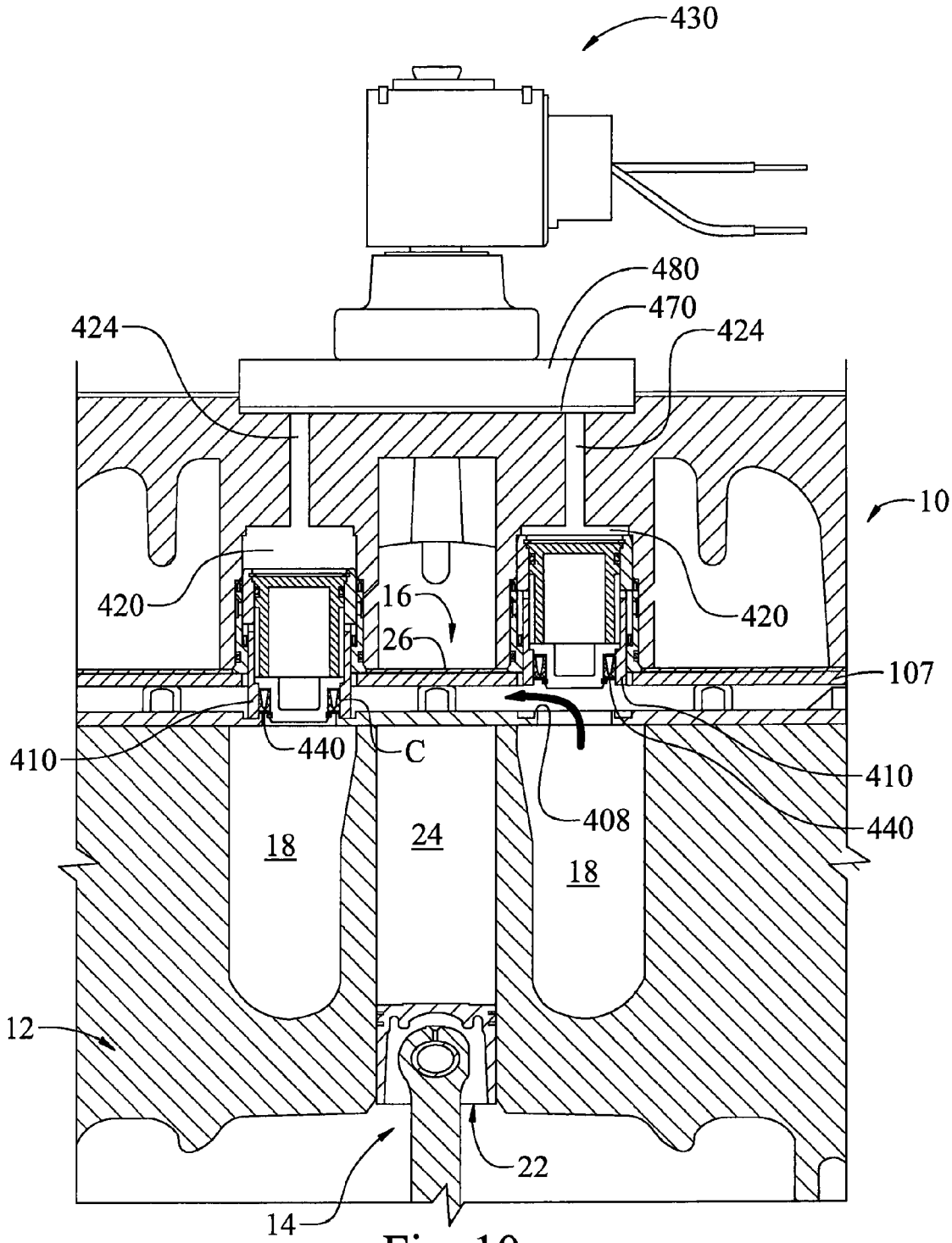
FIG. 10 is a cross-sectional view of a compressor and valve apparatus according to the present disclosure shown in a closed position and opened position.
Figure 11:
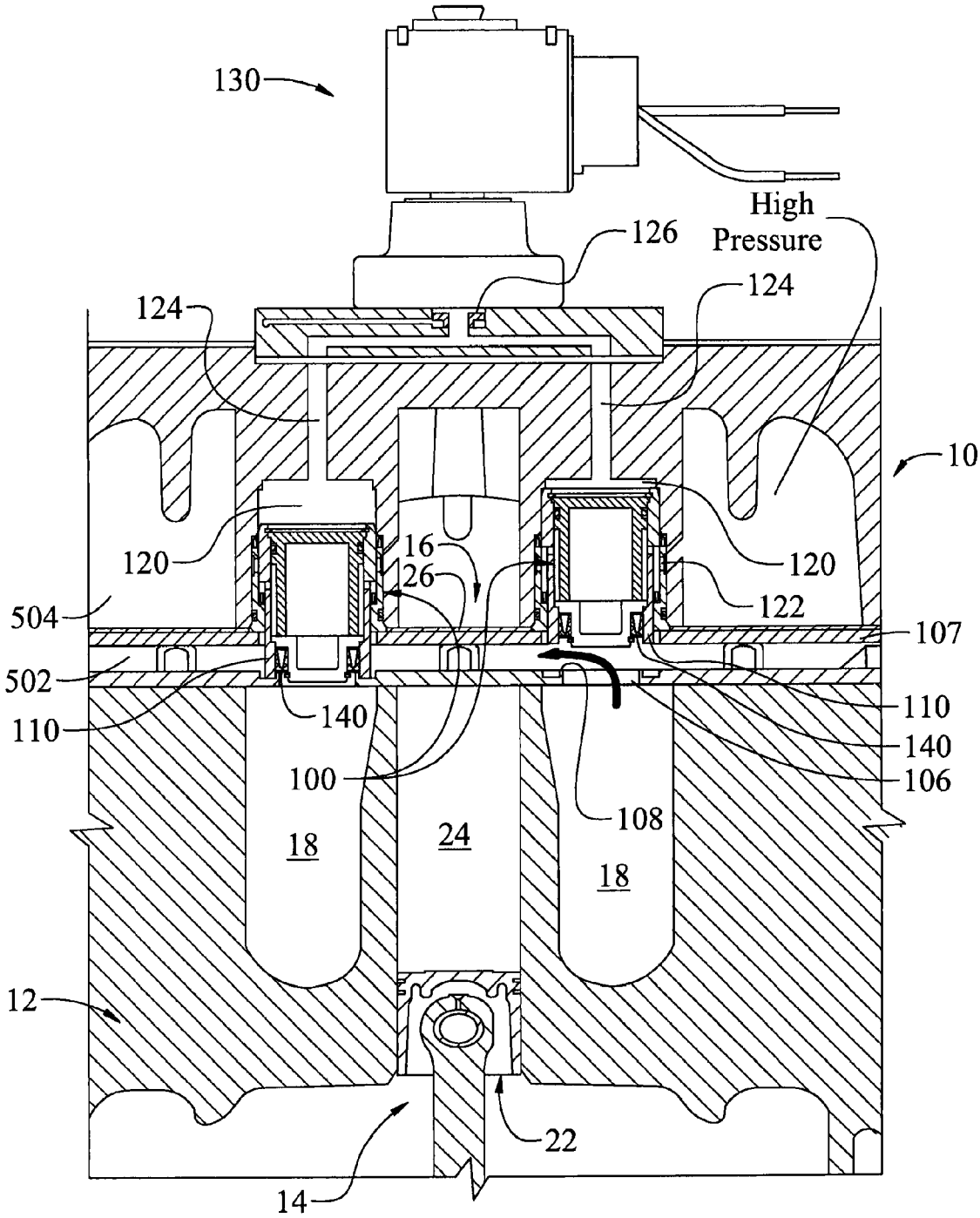
FIG. 11 is a schematic view of a compressor in combination with a valve apparatus according to the present disclosure.

The chamber 120 is formed in a body 102 of the valve apparatus 100 and slidably receives the piston 110 therein. The valve plate 107 may include a passage 104 formed therein and in selective communication with the valve opening 106. The passage 104 of the valve apparatus 100 may provide for communication of fluid to an inlet of the compressor 10, for example. The body 102 may include a control-pressure passage 124, which is in communication with the chamber 120. A control pressure may be communicated via the control-pressure passage 124 to chamber 120, to move the piston 110 relative to the valve opening 106. The body 102 may be positioned relative to the compression mechanism 14 such that the valve plate 107 is disposed generally between the compression mechanism 14 and the body 102 (FIGS. 1, 10, and 11).

When a pressurized fluid is communicated to the chamber 120, the piston 110 moves against valve opening 106 to prohibit fluid flow therethrough. In an application where the piston 110 blocks fluid flow to a suction inlet of a compressor 10 for "unloading" the compressor, the piston 110 may be referred to as an unloader piston. In such a compressor application, the pressurized fluid may be provided by the discharge-pressure gas of the compressor 10. Suction-pressure gas from the suction chamber 18 of the compressor 10 may also be communicated to the chamber 120, to bias the piston 110 away from the valve opening 106. Accordingly, the piston 110 is movable relative to the valve opening 106 to allow or prohibit fluid communication to passage 104.

With continued reference to FIG. 1, the piston 110 is moved by application of a control pressure to a chamber 120 in which the piston 110 is disposed. The volume within opening 106, generally beneath the piston 110 at 182, is at low pressure or suction pressure, and may be in communication with a suction-pressure gas of a compressor, for example. When the chamber 120 above the piston 110 is at a higher relative pressure than the area under the piston 110, the relative pressure difference causes the piston 110 to be urged in a downward direction within the chamber 120.

An O-ring seal 134 may be provided in an insert 136 installed in a wall 121 of the chamber 120 to provide a seal between the pressurized fluid within the chamber 120 and the low pressure passage 104. The chamber wall 121 may be integrally formed with the insert 136, thereby eliminate the need for the O-ring seal 134.

The piston 110 is pushed down by the difference in pressure above and below the piston 110 and by the pressure acting on an area defined by a diameter of a seal B. Accordingly, communication of discharge-pressure gas to the chamber 120 generally above the piston 110 causes the piston 110 to move toward and seal the valve opening 106.

The piston 110 may further include a disc-shaped sealing element 140 disposed at an open end of the piston 110. Blocking off fluid flow through the opening 106 is achieved when a valve seat 108 at opening 106 is engaged by the disc-shaped sealing element 140 disposed on the lower end of the piston 110.

The piston 110 may include a piston cylinder 114 with a plug 116 disposed therein proximate to an upper-end portion of the piston cylinder 114. The plug 116 may alternatively be integrally formed with the piston cylinder 114. The piston cylinder 114 may include a retaining member or lip 118 that retains the disc-shaped sealing element 140, a seal C, and a seal carrier or disk 142 within the lower end of the piston 110. A pressurized fluid (such as discharge-pressure gas, for example) may be communicated to the interior of the piston 110 through a port P. The sealing element 140 is moved into engagement with the valve seat 108 by the applied discharge-pressure gas at port P, which is trapped within the piston 110 by seal C. Specifically, the pressurized fluid inside the piston 110 biases the seal carrier 142 downward, which compresses seal C against the disc-shaped sealing element 140. The seal carrier 142, seal C, and the disc-shaped sealing element 140 are moveable within the lower end of the piston cylinder 114 by the discharge-pressure gas disposed within the piston 110. As described above, movement of the piston 110 into engagement with the valve seat 108 prevents flow through the valve opening 106.

As shown in FIG. 1, the piston 110 has a disc-shaped sealing element 140 slidably disposed in a lower portion of the piston 110. The retaining member 118 is disposed at the lower portion of the piston 110, and engages the disc-shaped sealing element 140 to retain the sealing element 140 within the lower end portion of the piston 110. The slidable arrangement of the sealing element 140 within the piston 110 permits movement of the piston 110 relative to the sealing element 140 when the sealing element 140 closes off the valve opening 106. When discharge-pressure gas is communicated to the chamber 120, the force of the discharge-pressure gas acting on the top of the piston 110 causes the piston 110 and sealing element 140 to move towards the raised valve seat 108 adjacent the valve opening 106. The disc-shaped sealing element 140 is held down against the valve opening 106 by the discharge-pressure gas applied on top of the disc-shaped sealing element 140. Suction-pressure gas is also disposed under the sealing element 140 at the annulus between the seal C and valve seat 108.

As shown in FIG. 1, the thickness of the retaining member 118 is less than the height of the valve seat 108. The relative difference between the height of the retaining member 118 and the valve seat 108 is such that the sealing element 140 engages and closes off the valve seat 108 before the bottom of the piston 110 reaches the valve plate 107 in which the valve opening 106 and valve seat 108 are located. Specifically, the thickness of the retaining member or lip 118 is less than the height of the valve seat 108, such that when the sealing element 140 engages the valve seat 108, the retaining member 118 has not yet engaged the valve plate 107. The piston 110 may then continue to move or travel over and beyond the point of closure of the sealing element 140 against the valve seat 108, to a position where the retaining element 118 engages the valve plate 107.

The above "over-travel" distance is the distance that the piston 110 may travel beyond the point the sealing element 140 engages and becomes stationary against the valve seat 108, before the retaining member 118 seats against the valve plate 107. This "over-travel" of the piston 110 results in relative movement between the piston 110 and the sealing element 140. Such relative movement results in the displacement of the seal C and seal carrier 142 against the pressure within the inside of the piston 110, which provides a force for holding the sealing element 140 against the valve seat 108. The amount of "over-travel" movement of the piston cylinder 114 relative to the sealing disc element 140 may result in a slight separation (or distance) D between the retaining member 118 and the sealing element 140, as shown in FIG. 1. In one configuration, the amount of over travel may be in the range of 0.001 to 0.040 inches, with a nominal of 0.020 inches.

The valve plate 107 arrests further movement of the piston 110 and absorbs the impact associated with the momentum of the mass of the piston 110 (less the mass of the stationary seal carrier 142, seal C, and sealing element 140). Specifically, the piston 110 is arrested by the retaining member 118 impacting against the valve plate 107 rather than against the then-stationary sealing element 140 seated on the valve seat 108. Thus, the sealing element 140 does not experience any impact imparted by the piston 110, thereby reducing damage to the sealing element 140 and extending the useful life of the valve apparatus 100. The kinetic energy of the moving piston 110 is therefore absorbed by the valve plate 107 rather than the sealing element 140 disposed on the piston 110.

The piston 110, including the sealing element 140, lends itself to applications where repetitive closure occurs, such as, for example, in duty-cycle modulation of flow to a pump, or suction flow to a compressor for controlling compressor capacity. By way of example, the mass of the piston assembly 110 may be as much as 47 grams, while the sealing element 140, seal carrier 142, and seal C may have a mass of only 1.3 grams, 3.7 grams and 0.7 grams respectively. By limiting the mass that will impact against the valve seat 108 to only the mass of the sealing element 140, seal carrier 142, and seal C, the seal element 140 and valve seat 108 avoid absorbing the kinetic energy associated with the much greater mass of the piston assembly 110. This feature reduces the potential for damage to the sealing element 140, and provides for extending valve function from about 1 million cycles to over 40 million cycles of operation. The piston 110 also provides improved retraction or upward movement of the piston 110, as will be described below.

Figure 3:
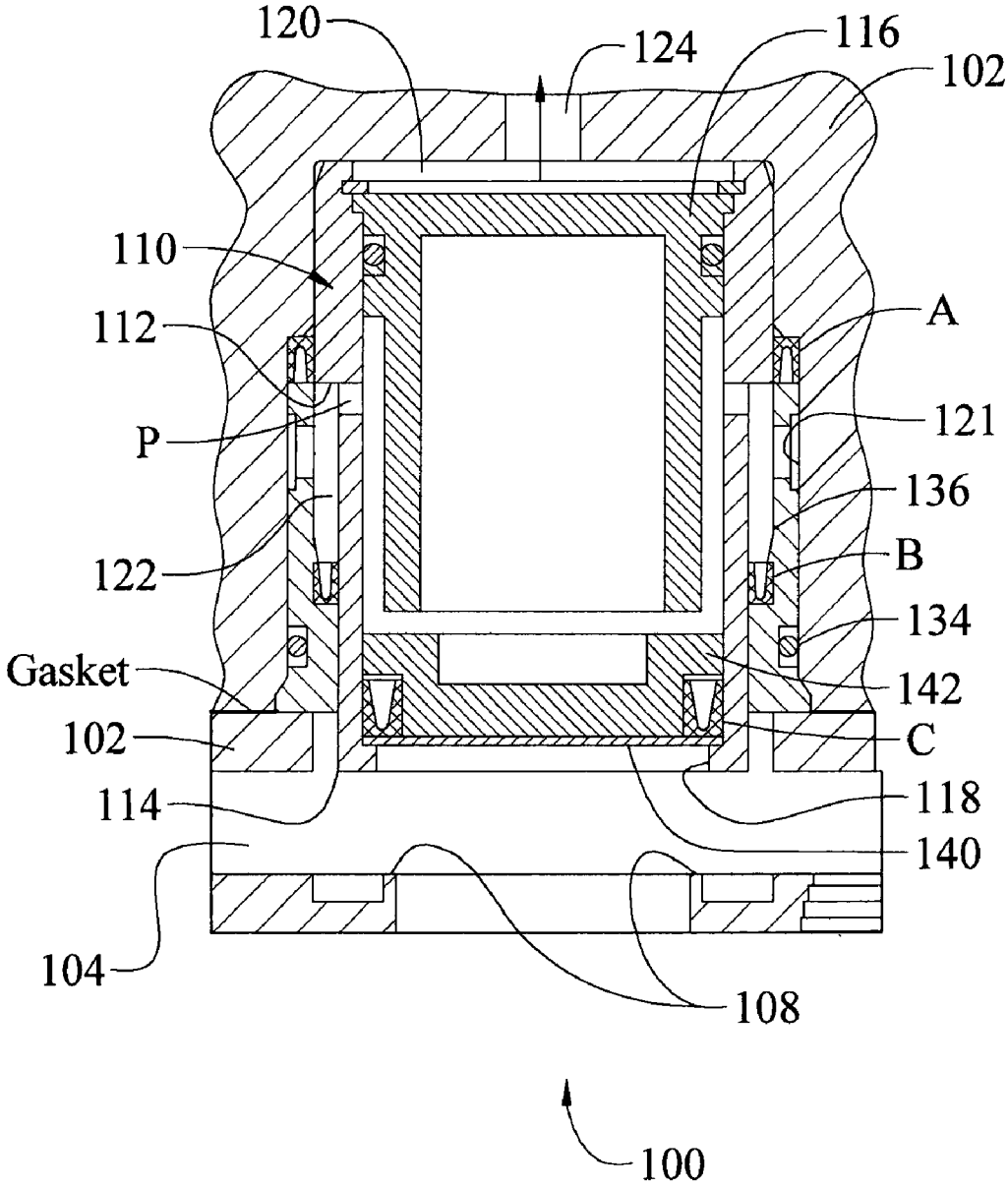
FIG. 3 is a cross-sectional view of the valve apparatus of FIG. 1 shown in an open position.
Figure 4:
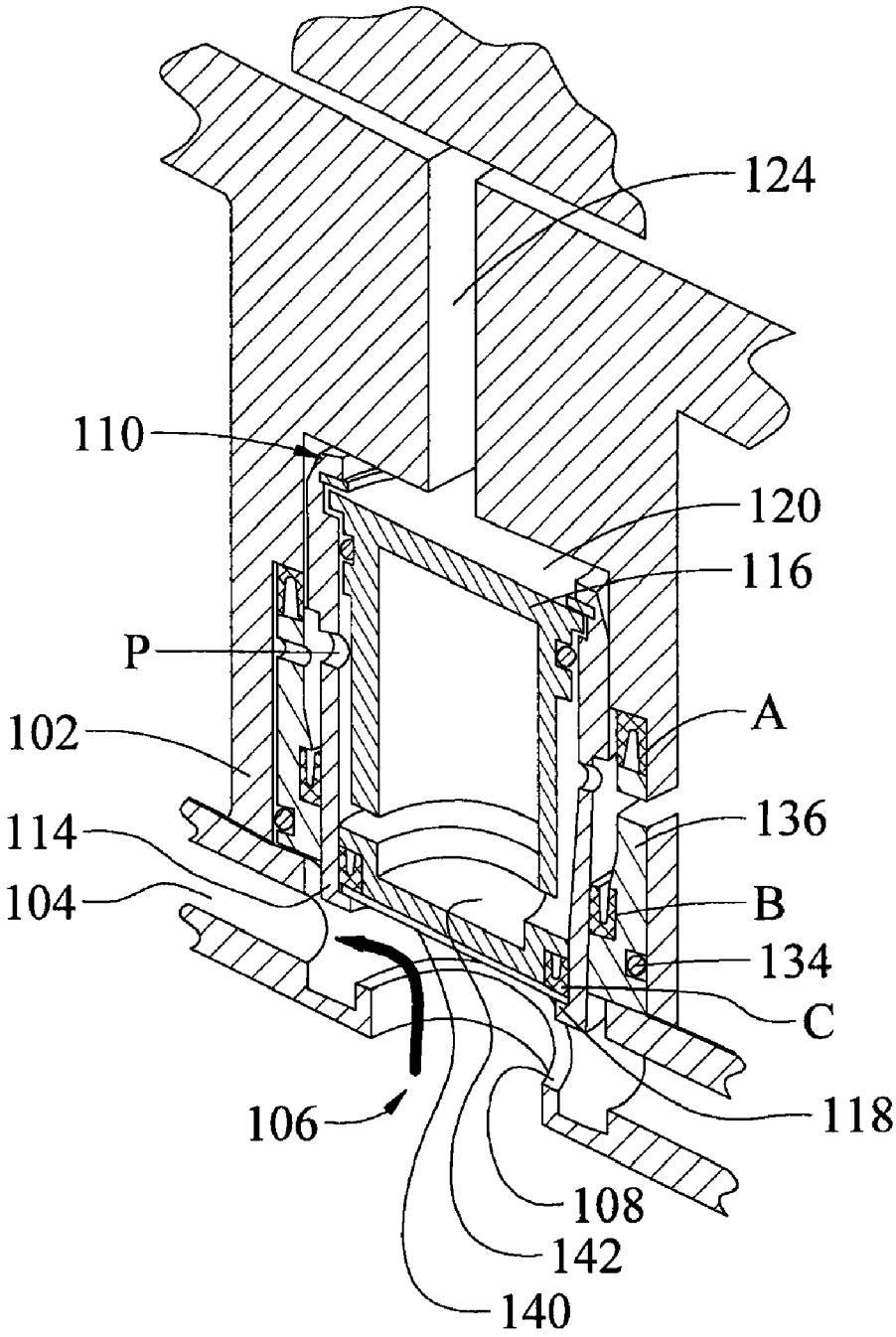
FIG. 4 is a perspective view of the valve apparatus of FIG. 3.

Referring to FIGS. 3 and 4, the piston 110 is shown in the open state relative to the valve opening 106. Chamber 120 may be placed in communication with a low pressure fluid source (such as suction pressure gas from a compressor, for example) to allow the piston 110 to move away from the valve opening 106 and permit suction flow therethrough. A valve member 126 (shown in FIGS. 5 and 6) must move from a first position (FIG. 5) to a second position (FIG. 6) in order to supply low pressure gas into control-pressure passage 124 and chamber 120. Only after low pressure gas (e.g., suction pressure gas) is in chamber 120 will the piston 110 be urged upward. In other words, high pressure gas is trapped in chamber 120 until the chamber 120 is vented to suction pressure by the movement of valve member 126 into the second position. The piston 110 is maintained in the open state while a low pressure or suction pressure is communicated to the chamber 120. In this state, the piston 110 is positioned for full capacity, with suction gas flowing unrestricted through valve opening 106 and into a suction passage 104 within the valve plate 107. Suction-pressure gas in communication with the chamber 120 above the piston 110 allows the piston 110 to move in an upward direction relative to the body 102. Suction-pressure gas may be in communication with the chamber 120 via the suction passage 104 in the valve plate 107.

The piston 110 may be moved away from the valve opening 106 by providing a pressurized fluid to a control volume or passage 122 that causes the piston 110 to be biased in an upward direction as shown in FIG. 3. The seals A and B positioned between the piston 110 and chamber 120 together are configured to define a volume 122 therebetween that, when pressurized, causes the piston 110 to move upward and away from the valve opening 106. Specifically, the mating surfaces of the piston 110 and chamber 120 are configured to define a volume 122 therebetween that is maintained in a sealed manner by an upper seal A and lower seal B. The piston 110 may further include a shoulder surface 112 against which pressurized fluid disposed within the volume 122 and between seals A and B expands and pushes against the shoulder 112 to move the piston 110 within the chamber 120.

Seal A serves to keep pressurized fluid within the volume 122 between the chamber 120 and piston 110 from escaping to the chamber 120 above the piston 110. In one configuration, discharge-pressure gas is supplied through passage 111 and orifice 113 which feeds the volume 122 bounded by seal A and seal B between the piston 110 and chamber 120. The volume on the outside of the piston 110, trapped by seal A and seal B, is always charged with discharge-pressure gas, thereby providing a lifting force when suction-pressure gas is disposed above piston 110 and within a top portion of the chamber 120 proximate to control-pressure passage 124. Using gas pressure exclusively to lift and lower the piston 110 eliminates the need for springs and the disadvantages associated with such springs (e.g., fatigue limits, wear and piston side forces, for example). While a single piston 110 is described, a valve apparatus 100 having multiple pistons 110 (i.e., operating in parallel, for example) may be employed where a compressor or pump includes multiple suction paths.

The valve apparatus 100 may be a separate component that is spaced apart from but fluidly coupled to an inlet of a compressor, or may alternatively be attached to a compressor (not shown). The valve apparatus 100 may be operated together with a compressor, for example, as an independent unit that may be controlled by communication of a control pressure via an external flow control device. It should be noted that various flow control devices may be employed for selectively communicating one of a suction-pressure gas and a discharge-pressure gas to the control-pressure passage 124 to move the piston 110 relative to the opening 106.

Figure 5:
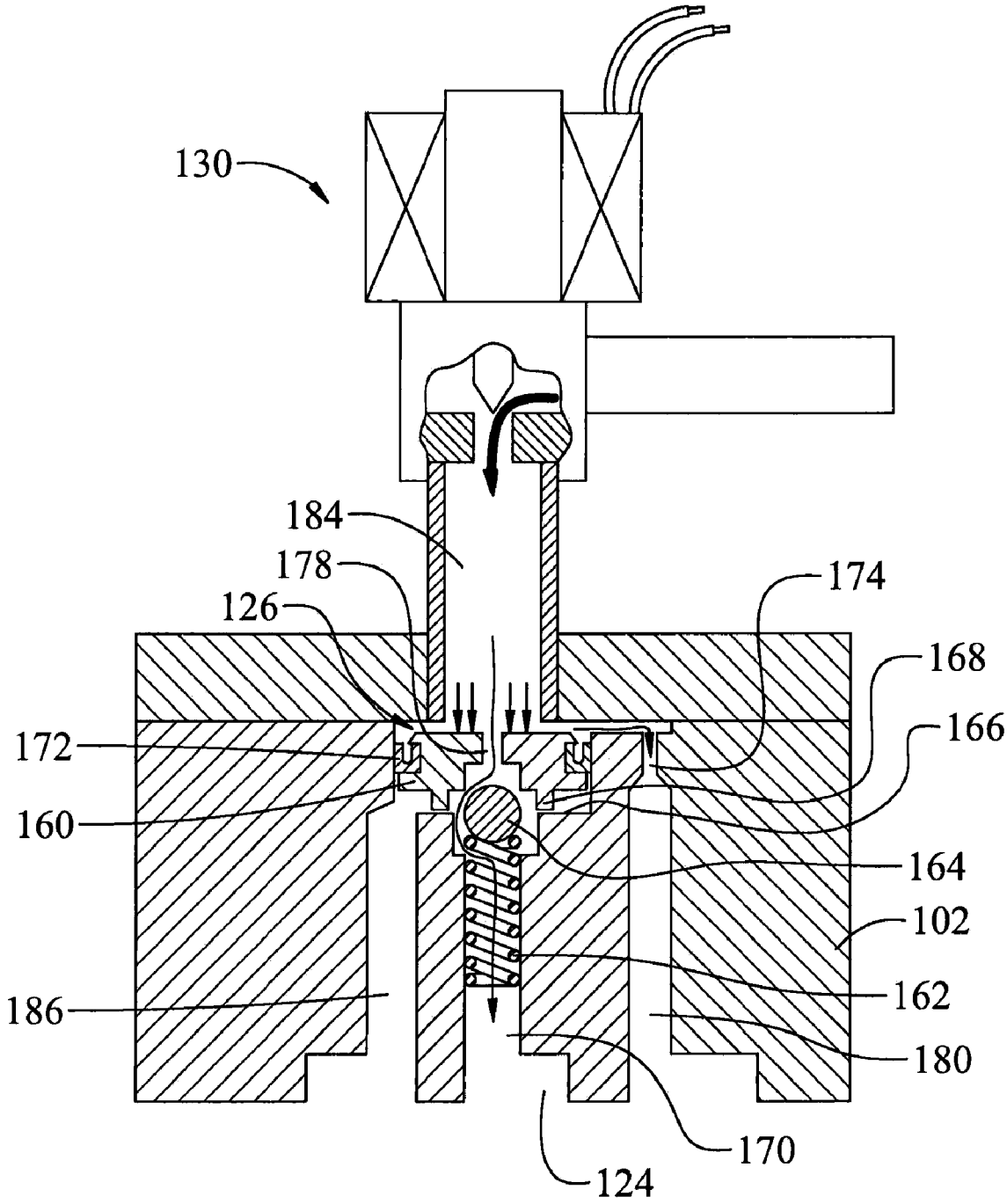
FIG. 5 is a cross-sectional view of a pressure-responsive valve member shown in a first position.
Figure 6:
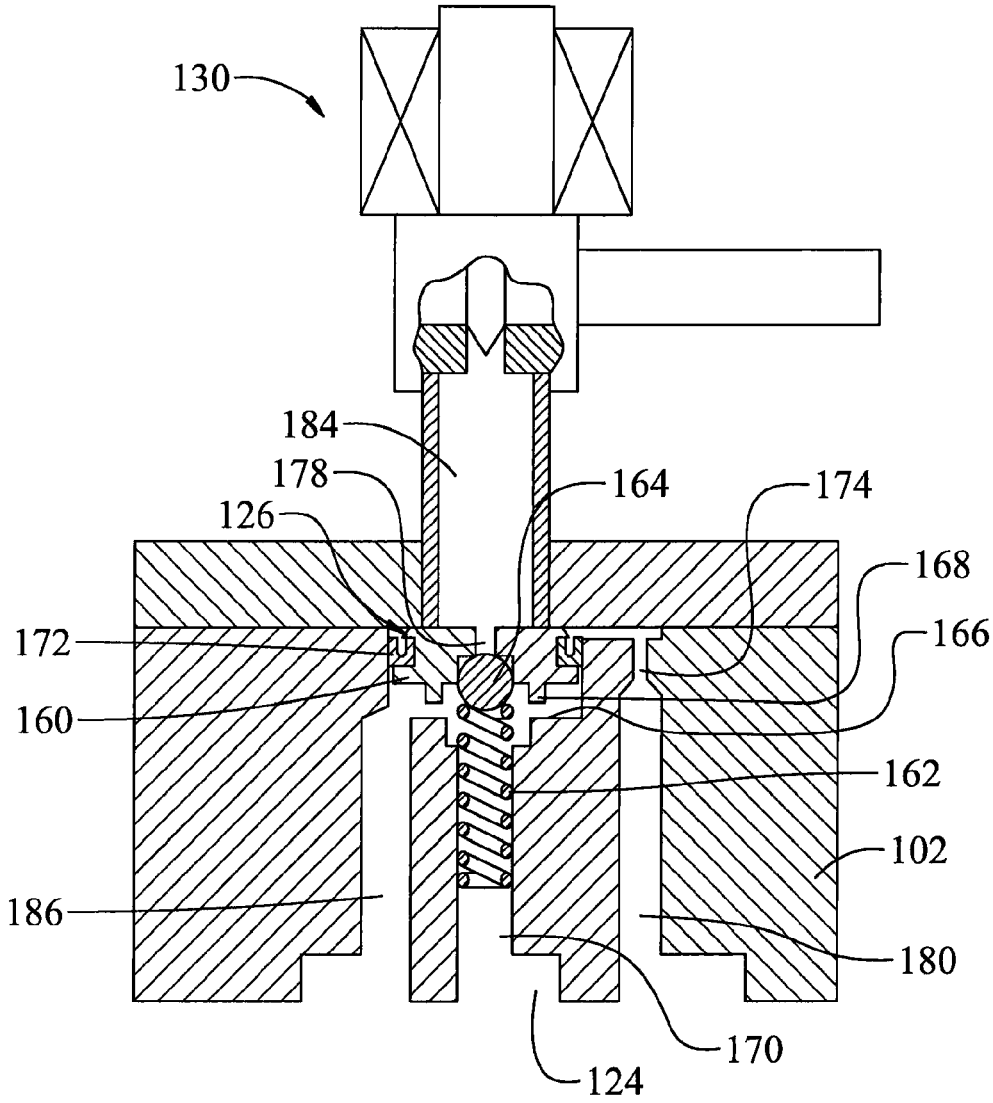
FIG. 6 is a cross-sectional view of the pressure-responsive valve member of FIG. 5 shown in a second position.

Referring to FIGS. 5 and 6, the valve apparatus 100 may further include a pressure-responsive valve member 126 proximate the control-pressure passage 124. The pressure-responsive valve member 126 may communicate a control pressure to the control-pressure passage 124 to move the piston 110, as previously discussed above. The valve member 126 is movable between first and second positions in response to the communication of pressurized fluid to the valve member 126. When a pressurized fluid is communicated to the valve member 126, the valve member 126 may be moved to the first position to permit communication of high-pressure gas to the control-pressure passage 124 to urge the piston 110 to a closed position. The pressurized fluid may be a discharge pressure gas from a compressor, for example. In the first position, the valve member 126 may also prohibit fluid communication between the control-pressure passage 124 and a low pressure or suction-pressure passage 186.

In the absence of pressurized fluid, the valve member 126 is moved to a second position where fluid communication between the control-pressure passage 124 and the suction-pressure passage 186 is permitted. The suction-pressure may be provided by communication with a suction line of a compressor, for example. The valve member 126 (shown in FIGS. 5 and 6) must move to the second position in order to supply low pressure gas into control-pressure passage 124 and chamber 120. Only after low pressure gas (e.g., suction pressure gas, for example) is in chamber 120 will the piston 110 be urged upward. In other words, high pressure gas is trapped in chamber 120 until it is vented to suction pressure by the movement of valve member 126 into the second position. The valve member 126 is movable between the first position where fluid communication between the control-pressure passage 124 and the suction-pressure passage 186 is prohibited and the second position where fluid communication between the control-pressure passage 124 and suction-pressure passage 186 is permitted. Accordingly, the valve member 126 is selectively moveable for communicating one of the suction-pressure gas and discharge-pressure gas to the control-pressure passage 124.

The valve member 126 is movable between the first position shown in FIG. 5, and the second position shown in FIG. 6, depending on the application of high-pressure gas to the valve member 126. When the valve member 126 is in communication with a pressurized fluid, the valve member 126 is moved to the first position, as shown in FIG. 5. The pressurized fluid may be a discharge pressure gas from a compressor, for example.

As shown in FIG. 5, the valve member 126 includes a pressure-responsive slave piston 160 and seal seat 168. The slave piston 160 responds to a high-pressure input (such as discharge pressure gas from a compressor, for example), by moving downward against a seal surface 166. The pressure-responsive valve member 126 includes the slave piston 160, a spring 162 for spring-loading a check valve or ball 164, a sealing surface 166 and mating seal seat 168, common port 170, a seal 172 on the slave piston outside diameter, and a vent orifice 174. Operation of the slave piston 160 is described below.

The slave piston 160 remains seated against a seal surface 166 when a pressurized fluid is in communication with the slave piston 160. The pressurized fluid may be a discharge pressure gas from a compressor, for example. When pressurized fluid is in communication with the volume above the slave piston 160, the pressurized fluid is allowed to flow through the pressure-responsive slave piston 160 via hole 178 in the center of the slave piston 160 and past the check-valve ball 164. This pressurized fluid, which is at or near discharge pressure, is communicated to the chamber 120 for pushing the piston 110 down against valve opening 106, as previously explained, such that suction flow is blocked and the compressor 10 is "unloaded." There is a pressure-drop past the check-valve ball 164, as a result of the pressurized fluid acting to overcome the force of the spring 162 biasing the check-valve ball 164 away from the hole 178. This pressure differential across the slave piston 160 is enough to push the slave piston 160 down against surface 166 to provide a seal. This seal effectively traps or restricts high pressure gas to the common port 170 leading to the control-pressure passage 124. The control-pressure passage 124 may be in communication with one or more chambers 120 for opening or closing one or more pistons 110. The common port 170 and control-pressure passage 124 directs discharge-pressure gas to chamber 120 against the piston 110, to thereby push the piston 110 down.

As long as high pressure (i.e., higher than system-suction pressure) exists above the slave piston 160, leakage occurs past the vent orifice 174. The vent orifice 174 is small enough to have a negligible effect on the system operating efficiency while leakage occurs past the vent orifice 174. The vent orifice 174 may include a diameter that is large enough to prevent clogging by debris and small enough to at least partially restrict flow therethrough to tailor an efficiency of the system. In one configuration, the vent orifice 174 may include a diameter of approximately 0.04 inches. The vent orifice 174 discharges upstream of the piston 110 at point 182 (see FIG. 1), so that the pressure downstream of the piston 110 at passage 104 remains substantially at vacuum. Specifically, when pressurized fluid flow pushes the piston 110 closed to block flow through valve opening 106, the fluid bleeding through the vent orifice 174 discharges through a suction passage 180 to a location 182 (see FIG. 1) on the closed or blocked side of the piston 110. The discharged fluid that is bled away through vent orifice 174 is blocked by the piston 110, and is not communicated through passage 104. Where the valve apparatus 100 controls fluid flow to a suction inlet of a compressor 10, for example, the absence of vented fluid flow through passage 104 to the compressor 10 would reduce power consumption of the compressor 10. Venting of discharge gas upstream of the piston 110 reduces power consumption of the compressor 10 by allowing the pressure downstream of the piston 110 to more quickly drop into a vacuum.

Referring to FIG. 6, the slave piston 160 (or valve member 126) is shown in a second position, where communication of pressurized fluid or discharge-pressure gas to the slave piston 160 is prohibited. In this position, the valve chamber is in communication with the suction-pressure passage 186, such that the piston 110 is moved into the "loaded" position. The internal volume of the chamber or passage 184 between the solenoid valve 130 and the slave piston 160 is as small as practical (considering design and economic limitations), such that the amount of trapped pressurized fluid therein may be bled off quickly to effectuate a fast closure of the piston 110. When communication of pressurized fluid to the slave piston 160 is discontinued, the pressure trapped above the slave piston bleeds past the vent orifice 174. As the pressure drops above the slave piston 160 the check valve 164 is closed against hole 178, which prevents pressure in the common port 170 from flowing into the chamber above the slave piston 160. The common port 170 that feeds the chamber 120 above the piston 110 may also be referred to as the "common" port, particularly where the valve apparatus 100 includes a plurality of pistons 110.

There is a pressure balance point across the slave piston 160, whereby bleed-off through the vent orifice 174 causes further lowering of top-side pressure and lifts the slave piston 160 upwards, unseating the slave piston 160 from the seal surface 166. At this point, pressure in the common port 170 is vented across the slave piston seal seat 168 and into the suction-pressure passage 186. The suction-pressure passage 186 establishes communication of suction pressure through the common port 170 to the chamber 120, and the piston 110 then lifts when the pressure on top of the piston 110 drops. Additionally, the use of a pressure drop across the slave piston's check valve 164 (in the un-checked direction) will serve to reduce the amount of fluid mass needed to push the piston 110 down.

Use of a slave piston 160 to drive the piston 110 provides for rapid response of the piston 110. The response time of the valve apparatus 100 is a function of the size of the vent orifice 174 and the volume above the slave piston 160 in which pressurized fluid is trapped. Where the valve apparatus 100 controls fluid flow to a suction inlet of a compressor 10, for example, reducing the volume of the common port 170 will improve response time and require less usage of refrigerant per cycle to modulate the compressor. While the above pressure-responsive slave piston 160 is suitable for selectively providing one of a discharge-pressure gas or a suction-pressure gas to a control-pressure passage 124, other alternative means for providing a pressure-responsive valve member may be used in place of the above, as described below.

Figure 7:
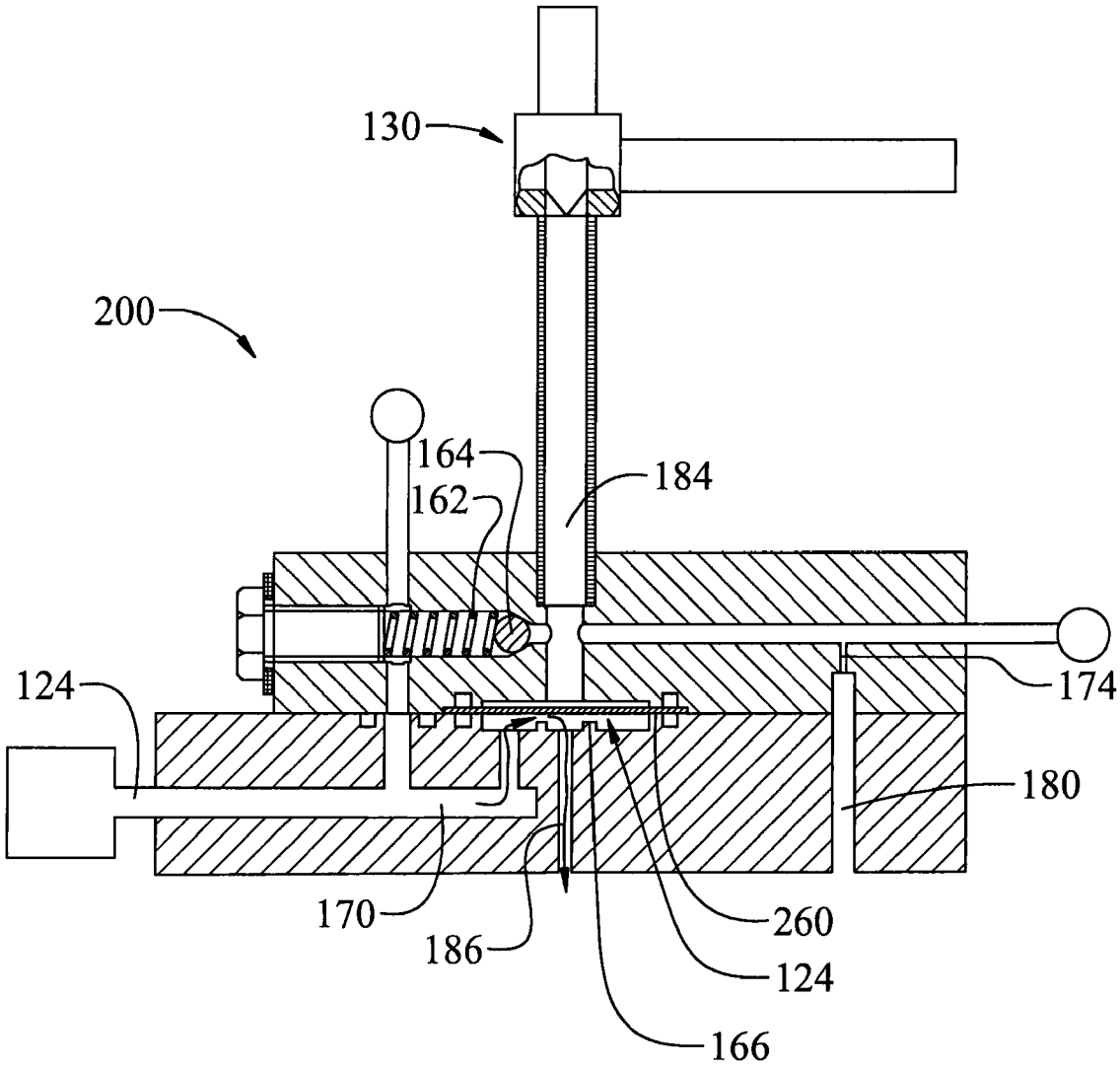
FIG. 7 is a cross-sectional view of a pressure-responsive valve member according to the present disclosure shown in a closed position.

Referring to FIG. 7, an alternate construction of a pressure-responsive valve 200 is shown in which the slave piston 160 of the first embodiment is replaced by a diaphragm valve 260. As shown in FIG. 7, the valve member or diaphragm 260 is spaced apart from the sealing surface 166 such that suction-pressure gas in passage 186 is in communication with common port 170 and control-pressure passage 124 for biasing the piston 110 to an open position. Communication of pressurized fluid (i.e., discharge-pressure gas) to the top side of the diaphragm 260 causes the diaphragm 260 to move down and seal against the sealing surface 166 to prohibit communication of suction-pressure gas at 186 to the control-pressure passage 124. The pressurized fluid also displaces the check valve 164 to establish communication of pressurized fluid to the common port 170 and control-pressure passage 124, to thereby move the piston 110 into a closed position. In this construction, the common port 170 is disposed under the diaphragm valve 260, and the suction-pressure passage 186 is disposed under the middle of the diaphragm valve 260. The fundamental concept of operation is the same as the valve embodiment shown in FIG. 6.

A valve apparatus 100 including the above pressure-responsive valve member 126 may be operated together with a compressor, for example, as an independent unit that may be controlled by communication of pressurized fluid (i.e., discharge pressure) to the pressure-responsive valve member 126. It should be noted that various flow control devices may be employed for selectively allowing or prohibiting communication of discharge pressure to the pressure-responsive valve member.

The valve apparatus 100 may further include a solenoid valve 130, for selectively allowing or prohibiting communication of discharge-pressure gas to the pressure-responsive valve member 126.

Referring to FIGS. 5-9, a solenoid valve 130 is provided that is in communication with a pressurized fluid. The pressurized fluid may be a discharge pressure gas from the compressor 10, for example. The solenoid valve 130 is movable to allow or prohibit communication of pressurized fluid to the valve member 126 or slave piston 160. The solenoid valve 130 functions as a two-port (on/off) valve for establishing and discontinuing communication of discharge-pressure gas to the slave piston 160, which responds as previously described.

In connection with the pressure-responsive valve member 126, the solenoid valve 130 substantially has the output functionality of a three-port solenoid valve (i.e., suction-pressure gas or discharge-pressure gas may be directed to the common port 170 or control-pressure passage 124 to raise or lower the piston 110). When the solenoid valve 130 is energized (via wires 132) to an open position, the solenoid valve 130 establishes communication of discharge-pressure gas to the slave piston 160. The slave piston 160 is responsively moved to a first position where it is seated against a seal surface 166, as previously described and shown in FIG. 5. While the solenoid valve 130 is energized and discharge-pressure gas is communicated to the slave piston 160 and chamber 120, the piston 110 closes the suction gas flow passage 186 in the vicinity of the opening 106 in the valve plate 107. When the solenoid valve 130 is de-energized to prohibit communication of pressurized fluid, the slave piston 160 moves to the second position where communication of suction pressure is established with the control-pressure passage 124 and chamber 120. As previously described, suction pressure in communication with the chamber 120 above the piston 110 biases the piston 110 in an upward direction. While the solenoid valve 130 is de-energized and suction pressure is communicated to the control-pressure passage 124, the piston 110 is positioned for full capacity with suction gas flowing unrestricted through valve opening 106 into a suction passage 128. Suction-pressure gas is in communication with the chamber 120 via the suction passage 128 in the valve plate 107.

Figure 8:
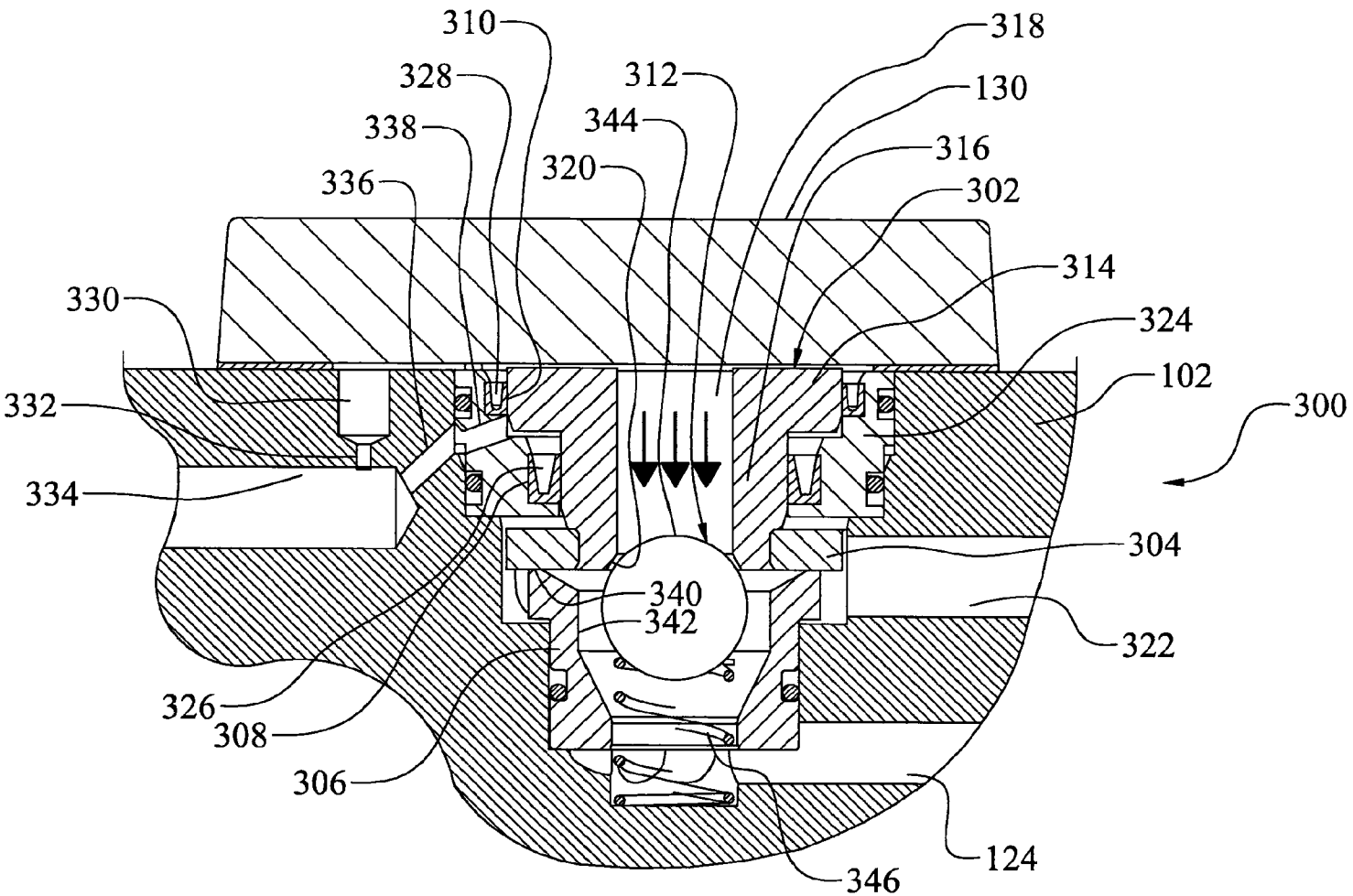
FIG. 8 is a cross-sectional view of a pressure-responsive valve according to the present disclosure shown in a first position.
Figure 9:
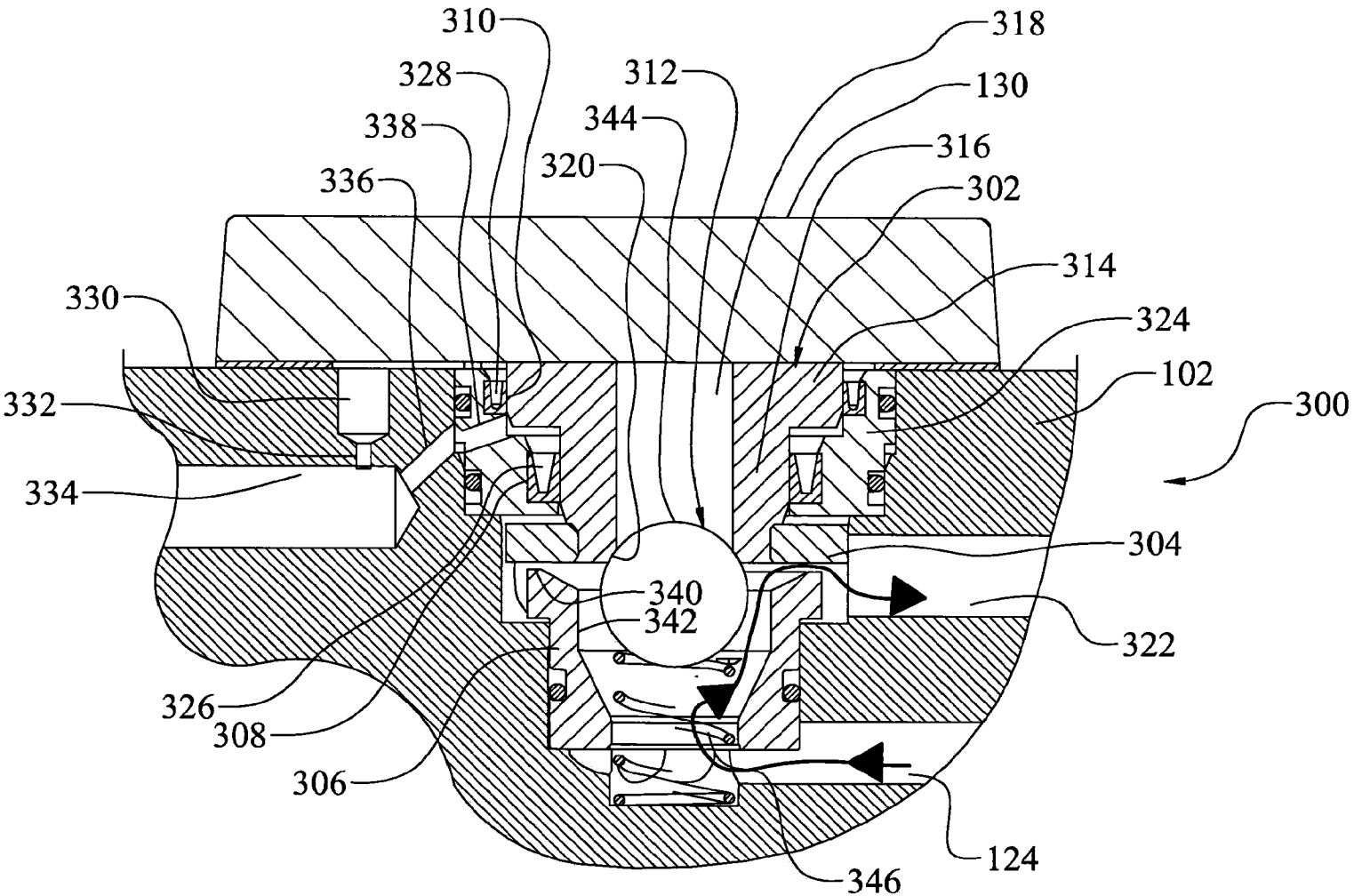
FIG. 9 is a cross-sectional view of the pressure-responsive valve of FIG. 8 shown in a second position.

Referring to FIGS. 8 and 9, a pressure-responsive valve 300 is provided and may include a first-valve member 302, a second-valve member 304, a valve seat member 306, an intermediate-isolation seal 308, an upper seal 310, and a check valve 312. The pressure-responsive valve 300 is movable in response to the solenoid valve 130 being energized and de-energized to facilitate movement of the piston 110 between the unloaded and loaded positions.

The first-valve member 302 may include an upper-flange portion 314, a longitudinally extending portion 316 extending downward from the upper-flange portion 314, and a longitudinally extending passage 318. The passage 318 may extend completely through the first-valve member 302 and may include a flared check valve seat 320.

The second-valve member 304 may be an annular disk disposed around the longitudinally extending portion 316 of the first valve member 302 and may be fixedly attached to the first-valve member 302. While the first- and second-valve members 302, 304 are described and shown as separate components, the first- and second-valve members 302, 304 could alternatively be integrally formed. The first and second-valve members 302, 304 (collectively referred to as the slave piston 302, 304) are slidable within the body 102 between a first position (FIG. 8) and a second position (FIG. 9) to prohibit and allow, respectively, fluid communication between the control-pressure passage 124 and a vacuum port 322.

The intermediate-isolation seal 308 and the upper seal 310 may be fixedly retained in a seal-holder member 324, which in turn, is fixed within the body 102. The intermediate-isolation seal 308 may be disposed around the longitudinally extending portion 316 of the first-valve member 302 (i.e., below the upper-flange portion 314) and may include a generally U-shaped cross section. An intermediate pressure cavity 326 may be formed between the U-Shaped cross section of the intermediate-isolation seal 308 and the upper-flange portion 314 of the first-valve member 302.

The upper seal 310 may be disposed around the upper-flange portion 314 and may also include a generally U-shaped cross section that forms an upper cavity 328 beneath the base of the solenoid valve 130. The upper cavity 328 may be in fluid communication with a pressure reservoir 330 formed in the body 102. The pressure reservoir 330 may include a vent orifice 332 in fluid communication with a suction-pressure port 334. The suction-pressure port 334 may be in fluid communication with a source of suction gas such as, for example, a suction inlet of a compressor. Feed drillings or passageways 336, 338 may be formed in the body 102 and seal-holder member 324, respectively, to facilitate fluid communication between the suction-pressure port 334 and the intermediate pressure cavity 326 to continuously maintain the intermediate pressure cavity 326 at suction pressure. Suction pressure may be any pressure that is less than discharge pressure and greater than a vacuum pressure of the vacuum port 322. Vacuum pressure, for purposes of the present disclosure, may be a pressure that is lower than suction pressure and does not need to be a pure vacuum.

The valve seat member 306 may be fixed within the body 102 and may include a seat surface 340 and an annular passage 342. In the first position (FIG. 8), the second-valve member 304 is in contact with the seat surface 340, thereby forming a seal therebetween and prohibiting communication between the control-pressure passage 124 and the vacuum port 322. In the second position (FIG. 9), the second-valve member 304 disengages the seat surface 340 to allow fluid communication between the control-pressure passage 124 and the vacuum port 322.

The check valve 312 may include a ball 344 in contact with spring 346 and may extend through the annular passage 342 of the valve seat member 306. The ball 344 may selectively engage the check valve seat 320 of the first-valve member 302 to prohibit communication of discharge gas between the solenoid valve 130 and the control-pressure passage 124.

With continued reference to FIGS. 8 and 9, operation of the pressure-responsive valve 300 will be described in detail. The pressure-responsive valve 300 is selectively movable between a first position (FIG. 8) and a second position (FIG. 9). The pressure-responsive valve 300 may move into the first position in response to the discharge gas being released by the solenoid valve 130. Specifically, as discharge gas flows from the solenoid valve 130 and applies a force to the top of the upper-flange portion 314 of the first-valve member 302, the valve members 302, 304 are moved into a downward position shown in FIG. 8. Forcing the valve members 302, 304 into the downward position seals the second-valve member 304 against the seat surface 340 to prohibit fluid communication between the vacuum port 322 and the control-pressure passage 124.

The discharge gas accumulates in the upper cavity 328 formed by the upper seal 310 and in the discharge gas reservoir 330, where it is allowed to bleed into the suction-pressure port 334 through the vent orifice 332. The vent orifice 332 has a sufficiently small diameter to allow the discharge gas reservoir to remain substantially at discharge pressure while the solenoid valve 130 is energized.

A portion of the discharge gas is allowed to flow through the longitudinally extending passage 318 and urge the ball 344 of the check valve 312 downward, thereby creating a path for the discharge gas to flow through to the control-pressure passage 124 (FIG. 8). In this manner, the discharge gas is allowed to flow from the solenoid valve 130 and into the chamber 120 to urge the piston 110 downward into the unloaded position.

To return the piston 110 to the upward (or loaded) position, the solenoid valve 130 may be de-energized, thereby prohibiting the flow of discharge gas therefrom. The discharge gas may continue to bleed out of the discharge gas reservoir 330 through the vent orifice 332 and into the suction-pressure port 334 until the longitudinally extending passage 318, the upper cavity 328, and the discharge gas reservoir 330 substantially reach suction pressure. At this point, there is no longer a net downward force urging the second-valve member 304 against the seat surface 340 of the valve seat member 306. The spring 346 of the check valve 312 is thereafter allowed to bias the ball 344 into sealed engagement with check valve seat 320, thereby prohibiting fluid communication between the control-pressure passage 124 and the longitudinally extending passage 318.

As described above, the intermediate pressure cavity 326 is continuously supplied with fluid at suction pressure (i.e., intermediate pressure), thereby creating a pressure differential between the vacuum port 322 (at vacuum pressure) and the intermediate pressure cavity 326 (at intermediate pressure). The pressure differential between the intermediate pressure cavity 326 and the vacuum port 322 applies a force on valve members 302, 304 and urges the valve members 302, 304 upward. Sufficient upward movement of the valve members 302, 304 allows fluid communication between the chamber 120 and the vacuum port 322. Placing chamber 120 in fluid communication with the vacuum port 322 allows the discharge gas occupying chamber 120 to evacuate through the vacuum port 322. The evacuating discharge gas flowing from chamber 120 to vacuum port 322 (FIG. 9) may assist the upward biasing force acting on the valve members 302, 304 by the intermediate pressure cavity 326. The upward biasing force of the check valve 312 against the check valve seat 320 may further assist the upward movement of the valve members 302, 304 due to engagement between the ball 344 of the check valve 302 and the valve seat 320 of the first-valve member 302. Once the chamber 120 vents back to suction pressure, the piston 110 is allowed to slide upward to the loaded position, thereby increasing the capacity of the compressor.

In a condition where a compressor is started with discharge and suction pressures being substantially balanced and the piston 110 is in the unloaded position, the pressure differential between the intermediate pressure cavity 326 and the vacuum port 322 provides a net upward force on the valve members 302, 304, thereby facilitating fluid communication between the chamber 120 and the vacuum port 322. The vacuum pressure of the vacuum port 322 will draw the piston 110 upward into the loaded position, even if the pressure differential between the intermediate-pressure cavity 326 and the area upstream of 182 is insufficient to force the piston 110 upward into the loaded position. This facilitates moving the piston 110 out of the unloaded position and into the loaded position at a start-up condition where discharge and suction pressures are substantially balanced.

Referring now to FIG. 10, another embodiment of a valve is provided that includes a plurality of pistons 410 (shown raised and lowered for illustration purposes only), each having a reed or valve ring 440 slidably disposed within the lower end of the piston 410. Operation of the valve ring 440 is similar to the sealing element 140 previously discussed in that discharge-pressure gas on top of the valve ring 440 holds the valve ring 440 against the valve seat 408 when the piston 410 is moved to the "down" position. Discharge-pressure gas above seal C is confined by the outside and inside diameter of the seal C. The valve ring 440 is loaded against the valve seat 408 by the pressure in the piston 410 acting against seal C, which has a high pressure above the seal C and a lower pressure (system suction and/or a vacuum) under the seal C. When the piston 410 is in the unloaded (downward) position and the valve ring 440 is against the valve seat 408, suction gas has the potential to leak between the upper surface of the valve ring 440 and the bottom surface of Seal C. The surface finish and design characteristics of seal C must be appropriately selected to prevent leakage at the interface between the upper surface of the valve ring 440 and the bottom surface of Seal C.

The use of a porting plate 480 provides a means for routing suction or discharge-pressure gas from the solenoid valve 430 to the chambers 420 on top of single or multiple pistons 410. The port on the solenoid valve 430 that controls the flow of gas to load or unload the pistons 410 is referred to as the "common" port 470, which communicates via control-pressure passage 424 to chambers 420. The solenoid valve 430 in this application may be a three-port valve in communication with suction and discharge-pressure gas and a common port 470 that is charged with suction or discharge-pressure gas depending on the desired state of the piston 410.

Capacity may be regulated by opening and closing one or more of the plurality of pistons 410 to control flow capacity. A predetermined number of pistons 410 may be used, for example, to block the flow of suction gas to a compressor, for example. The percentage of capacity reduction is approximately equal to the ratio of the number of "blocked" cylinders to the total number of cylinders. Capacity reduction may be achieved by the various disclosed valve mechanism features and methods of controlling the valve mechanism. The valve's control of discharge-pressure gas and suction-pressure gas may also be used in either a blocked suction application or in a manner where capacity is modulated by activating and de-activating the blocking pistons 410 in a duty-cycle fashion. Using multiple pistons 410 to increase the available flow area will result in increased full-load compressor efficiency.

Furthermore, it is recognized that one or more pistons 110 forming a bank of valve cylinders may be modulated together or independently, or one or more banks may not be modulated while others are modulated. The plurality of banks may be controlled by a single solenoid valve with a manifold, or each bank of valve cylinders may be controlled by its own solenoid valve. The modulation method may comprise duty-cycle modulation that for example, provides an on-time that ranges from zero to 100% relative to an off-time, where fluid flow may be blocked for a predetermined off-time period. Additionally, the modulation method used may be digital (duty-cycle modulation), conventional blocked suction, or a combination thereof. The benefit of using a combination may be economic. For example, a full range of capacity modulation in a multi-bank compressor may be provided by using a lower-cost conventional blocked suction in all but one bank, where the above described digital modulation unloader piston configuration is provided in the one remaining bank of cylinders.

FIG. 11 shows a portion of the compressor 10 that includes a passage 502 in communication with a suction inlet of the compressor 10, and a chamber 504 in communication with a discharge pressure of the compressor 10. The portion of the compressor 10 shown in FIG. 11 further includes the valve apparatus 100. The compressor 10 including the valve apparatus 100 has at least one unloader valve (i.e., piston 110) for controllably modulating fluid flow to passage 502 in communication with a suction inlet of the compressor 10.

As previously described and shown in FIG. 1, the valve apparatus 100 has at least one valve opening 106 therein leading to the passage 502 in communication with the suction inlet of the compressor 10. A piston 110 is slidably disposed within a chamber 120 in the valve apparatus 100. The piston 110 is movable to block the valve opening 106 to prohibit flow therethrough to passage 502. The piston 110 and chamber 120 define a volume 122 therebetween, where communication of a discharge-pressure gas to the volume 122 establishes a biasing force that urges the piston 110 away from the valve opening 106.

The compressor 10 further includes a control-pressure passage 124 in communication with the chamber 120, where the control-pressure passage 124 communicates one of suction-pressure gas or a discharge-pressure gas to the chamber 120. The communication of discharge-pressure gas to the chamber 120 causes the piston 110 to move to block the valve opening 106 to prohibit flow therethrough. The communication of suction-pressure gas to the chamber 120 and communication of discharge-pressure gas to the volume 122 causes the piston 110 to move away from the valve opening 106 to permit flow therethrough.

The compressor 10 may further include a valve member 126 proximate the control-pressure passage 124. As previously described and shown in FIG. 5, the valve member 126 is movable between a first position where the control-pressure passage 124 is prohibited from communication with suction passage 502, and a second position in which the control-pressure passage 124 is in communication with the suction passage 502. Alternatively, the compressor 10 could include the pressure-responsive valve 300, shown in FIGS. 8 and 9, to selectively allow and prohibit fluid communication between the control-pressure passage 124 and the suction passage 502.

The compressor 10 including the valve apparatus 100 may further include a solenoid valve 130 for establishing or prohibiting communication of discharge pressure to the valve member 126 (or the pressure-responsive valve 300). As previously described and shown in FIGS. 5-10, communication of discharge-pressure gas to the valve member 126 causes the valve member 126 to move to the first position. In the first position, discharge-pressure gas is communicated through the control-pressure passage 124 to the chamber 120 to cause the piston 110 to move against the valve opening 106 to block suction flow therethrough. Discontinuing or prohibiting communication of discharge-pressure gas causes the valve member 126 to move to the second position, in which suction-pressure gas communicates with the chamber 120 to urge the piston 110 away from the opening 106 and permit suction flow therethrough.

As previously described and shown in FIG. 1, the combination including the valve apparatus 100 may further include a valve element 140 slidably disposed within the piston 110 and configured to engage a valve seat 108 adjacent the valve opening 106. When the valve element 140 engages the valve seat 108, the valve element 140 is configured to remain stationary while the piston 110 slides relative to the stationary valve element 140 to seat against the valve opening 106. In this manner, the piston 110 does not impact against the valve element 140, thereby preventing damage to the valve element 140.

The one or more pistons 110 in the above disclosed compressor combination may be controlled by a solenoid valve assembly, for example, that directs either discharge pressure or suction pressure to the top of each piston 110. The solenoid or the pressure-responsive valve may be configured to vent the pressure above the valve member 126 (or slave piston 160 or 302, 304) to a low pressure source, such as a chamber at suction pressure or vacuum pressure on the closed side of the unloader piston. A single solenoid valve 130 may be capable of operating multiple unloader pistons 110 of the valve apparatus 100 simultaneously, through a combination of drillings and gas flow passages.

It should be noted that the compressor 10 and valve apparatus 100 may alternatively be operated or controlled by communication of a control pressure a separate external flow control device (FIGS. 8 and 9). Additionally, the compressor 10 including the valve apparatus 100 may comprise combinations of one or more of the above components or features, such as the solenoid assembly 130, which may be separate from or integral with the compressor 10.

What is claimed is:

1. An apparatus comprising:

a compression mechanism;

a valve plate associated with said compression mechanism and including at least one port in fluid communication with said compression mechanism;

a manifold disposed adjacent to said valve plate;

a cylinder formed in said manifold;

a piston disposed within said manifold and movable relative to said manifold between a first position separated from said valve plate and a second position contacting said valve plate;

a valve element disposed within said piston and movable relative to said piston and said manifold, said valve element movable between an open position spaced apart from said valve plate and permitting flow through said port and into said compression mechanism and a closed position engaging said valve plate and restricting flow through said port and into said compression mechanism.

2. The apparatus of claim 1, wherein said piston includes an inner volume having a pressurized fluid disposed therein.

3. The apparatus of claim 2, wherein said pressurized fluid imparts a force on said valve element to move said valve element against one end of said piston.

4. The apparatus of claim 2, wherein said pressurized fluid is discharge-pressure gas received from said compression mechanism.

5. The apparatus of claim 1, further comprising a chamber disposed between a top surface of said piston and an inner surface of said cylinder, said chamber selectively receiving a pressurized fluid to move said piston from said first position to said second position.

6. The apparatus of claim 5, wherein said pressurized fluid is discharge-pressure gas received from said compression mechanism.

7. The apparatus of claim 5, further comprising a valve member operable to selectively supply said chamber with pressurized fluid.

8. The apparatus of claim 7, wherein said valve member includes a solenoid valve.

9. The apparatus of claim 8, further comprising a check valve selectively allowing fluid communication between said solenoid valve and said chamber.

10. The apparatus of claim 7, wherein said valve member is responsive to a pressure differential between a vacuum pressure and an intermediate pressure.

11. The apparatus of claim 10, wherein said intermediate pressure is fed to a cavity defined by a slave piston seal and a slave piston.

12. The apparatus of claim 7, wherein said valve member includes a plurality of slave piston seals at least partially defining a plurality of cavities.

13. The apparatus of claim 1, wherein movement of said piston from said first position to said second position toward said port causes concurrent movement of said valve element toward said port.

14. The apparatus of claim 13, wherein said valve element engages said valve plate prior to engagement between said piston and said valve plate when said piston is moved from said first position to said second position.

15. The apparatus of claim 13, wherein said piston moves relative to said valve element when said valve element is in said closed position until said piston contacts said valve plate and is in said second position.

16. The apparatus of claim 13, wherein said valve element engages said valve plate causing relative movement between said piston and said valve element when said piston is moved from said first position to said second position.

17. The apparatus of claim 1, further comprising a seal disposed between said piston and said cylinder and including a seal chamber receiving a pressurized fluid that biases said piston into said first position.

18. An apparatus comprising:

a compression mechanism;

a valve plate associated with said compression mechanism and including at least one port in fluid communication with said compression mechanism;

a manifold disposed adjacent to said valve plate;

a cylinder formed in said manifold;

a piston disposed within said cylinder and movable relative to said cylinder between a first position spaced apart from the valve plate to allow flow through the port and into said compression mechanism and a second position engaging the valve plate to restrict flow through the port and into said compression mechanism;

a seal disposed between said piston and said cylinder and including a seal chamber receiving a first pressurized fluid therein to bias said piston into said first position;

a control mechanism in fluid communication with said cylinder and selectively supplying a second pressurized fluid to said cylinder to move said piston against a force applied on said piston by said first pressurized fluid disposed within said seal chamber to move said piston from said first position to said second position.

19. The apparatus of claim 18, further comprising a valve element movable with said piston between said first position and said second position, said valve element engaging the valve plate to prevent flow through the port when said piston is in said second position.

20. The apparatus of claim 19, wherein said valve element is movable relative to said piston.

21. The apparatus of claim 19, wherein said valve element contacts the valve plate prior to said piston reaching said second position.

22. The apparatus of claim 21, wherein contact between said valve element and the valve plate causes relative movement between said piston and said valve element.

23. The apparatus of claim 22, wherein said relative movement occurs until said piston engages the valve plate.

24. The apparatus of claim 18, wherein said seal is fixed relative to said cylinder.

25. The apparatus of claim 18, wherein said pressurized fluid is discharge-pressure gas received from the compressor.

26. The apparatus of claim 18, further comprising an injection port formed through said piston to place an interior volume of said piston in fluid communication with said seal chamber, said seal chamber supplying said interior volume with said first pressurized fluid via said injection port.

27. The apparatus of claim 26, further comprising a valve element slidably supported within said piston and urged against a first end of said piston by said first pressurized fluid disposed within said interior volume.

28. The apparatus of claim 18, wherein said control mechanism includes a solenoid valve.

29. The apparatus of claim 18, further comprising a check valve selectively allowing fluid communication between said solenoid valve and said piston.

30. The apparatus of claim 18, wherein said valve mechanism includes a cavity at least partially defined by an isolation seal and a slave piston.

31. The apparatus of claim 30, wherein a feed drilling provides fluid communication between said cavity and a system suction pressure port.

32. The apparatus of claim 30, wherein an intermediate pressure is supplied to said cavity to bias said slave piston toward an upward position.

33. The apparatus of claim 32, wherein valve mechanism allows discharge gas to evacuate through a vacuum port to when said slave piston is in said upward position.

34. The apparatus of claim 18, further comprising a chamber disposed within said cylinder between an inner surface of the manifold and an outer surface of said piston, said chamber in fluid communication with said control mechanism.

35. The apparatus of claim 34, wherein said control mechanism selectively supplies said chamber with said second pressurized fluid to move said piston from said first position to said second position.

36. The apparatus of claim 34, wherein said control mechanism selectively vents said chamber to allow said first pressurized fluid disposed within said seal chamber to move said piston from said second position to said first position.

* * * * *

UNITED STATES PATENT AND TRADEMARK OFFICE

CERTIFICATE OF CORRECTION

PATENT NO. : 8,157,538 B2
APPLICATION NO. : 12/177528
DATED : April 17, 2012
INVENTOR(S) : Frank S. Wallis et al.

It is certified that error appears in the above-identified patent and that said Letters Patent is hereby corrected as shown below:

| | |
|---|---|
| Column 4, Line 49 | "eliminate" should be --eliminating--. |
| Column 11, Line 29 | "U-Shaped" should be --U-shaped--. |
| Column 13, Line 37 | "Seal C" should be --seal C--. |
| Column 13, Line 41 | "Seal C" should be --seal C--. |
| Column 15, Line 37 | After "control pressure" insert --to--. |

Signed and Sealed this
Twenty-ninth Day of January, 2013

David J. Kappos

David J. Kappos
*Director of the United States Patent and Trademark Office*